US011324990B2

(12) United States Patent
Clark et al.

(10) Patent No.: US 11,324,990 B2
(45) Date of Patent: May 10, 2022

(54) MODULAR EXERCISE APPARATUS, SYSTEM, AND METHODS

(71) Applicants: Andrew F. Clark, Englewood, CO (US); Richard Gangl, Golden, CO (US); Deborah Lessen, New York, NY (US)

(72) Inventors: Andrew F. Clark, Englewood, CO (US); Richard Gangl, Golden, CO (US); Deborah Lessen, New York, NY (US)

( * ) Notice: Subject to any disclaimer, the term of this patent is extended or adjusted under 35 U.S.C. 154(b) by 190 days.

(21) Appl. No.: 16/660,636

(22) Filed: Oct. 22, 2019

(65) Prior Publication Data

US 2020/0121976 A1 Apr. 23, 2020

Related U.S. Application Data

(60) Provisional application No. 62/749,120, filed on Oct. 22, 2018.

(51) Int. Cl.
*A63B 21/00* (2006.01)
*A63B 21/04* (2006.01)

(52) U.S. Cl.
CPC ..... *A63B 21/4027* (2015.10); *A63B 21/0442* (2013.01); *A63B 21/4033* (2015.10); *A63B 21/4035* (2015.10); *A63B 2208/0233* (2013.01); *A63B 2225/09* (2013.01)

(58) Field of Classification Search
CPC ... A47C 9/002; A47C 7/5062; A63B 21/4027; A63B 21/4033; A63B 21/4035; A63B 21/0442; A63B 21/4047; A63B 21/4034; A63B 21/023; A63B 21/1609; A63B 21/055; A63B 2225/09; A63B 2225/093; A63B 2208/0233; A63B 23/1209; A63B 23/03541; A63B 23/0405; A63B 2071/027; A63B 2071/025; A63B 2210/50; A63B 2210/02; A63B 2225/10; A61H 7/00
USPC ..... 482/142; 297/383
See application file for complete search history.

(56) References Cited

U.S. PATENT DOCUMENTS 3,937,490 A * 2/1976 Nasr ..... A61G 5/1059 280/250.1
4,728,150 A * 3/1988 Gaudreau, Jr. ..... A47C 1/023 297/383
5,775,776 A * 7/1998 Schooler ..... B60N 2/23 297/375
5,928,116 A * 7/1999 Chiang ..... A63B 23/03525 482/72
6,461,283 B1 * 10/2002 Maron ..... A63B 21/023 482/123
6,488,333 B2 * 12/2002 Kim ..... B60N 2/0284 296/64
6,494,531 B1 * 12/2002 Kim ..... B60N 2/2821 297/94

(Continued)

FOREIGN PATENT DOCUMENTS

CN 106975197 * 3/2017 ..... A63B 21/4045

*Primary Examiner* — Megan Anderson
*Assistant Examiner* — Thao N Do
(74) *Attorney, Agent, or Firm* — Armstrong Teasdale LLP

(57) ABSTRACT

An exercise system includes a base module having a seat with a seat depth, and a vertically adjustable back configured to fixedly engage with the base module at a first seat depth and a second seat depth different from the first seat depth.

15 Claims, 29 Drawing Sheets

(56) References Cited

U.S. PATENT DOCUMENTS 6,767,040 B1 * 7/2004 Freijy ..... B60N 2/3031 296/65.09
7,222,920 B1 * 5/2007 Washington ..... A47C 1/023 297/353
7,654,944 B1 * 2/2010 Liu ..... A63B 21/4029 482/142
7,981,011 B1 * 7/2011 Batca ..... A63B 23/1209 482/100
9,573,012 B1 * 2/2017 Lee ..... A47C 9/002
9,827,162 B1 * 11/2017 Vidmar ..... A47C 7/006
9,914,013 B1 * 3/2018 Uhlrich ..... A63B 21/4047
10,130,835 B1 * 11/2018 Leonard ..... A61H 1/0222
10,398,937 B2 * 9/2019 Beaver ..... A63B 5/16
2003/0055365 A1 * 3/2003 Hazard ..... A47C 9/002 601/98
2003/0216231 A1 * 11/2003 Reitz ..... A63B 23/035 482/142
2004/0152572 A1 * 8/2004 Reitz ..... A63B 21/1609 482/140
2005/0003937 A1 * 1/2005 Chen ..... A63B 71/0036 482/104
2008/0051274 A1 * 2/2008 Greene ..... A63B 23/0222 482/142
2008/0090710 A1 * 4/2008 Chung ..... A63B 23/0494 482/142
2008/0246246 A1 * 10/2008 Dix ..... A61G 5/026 280/233
2009/0069161 A1 * 3/2009 Caldwell ..... A63B 23/12 482/138
2011/0065554 A1 * 3/2011 Van Straaten ..... A63B 21/0552 482/130
2013/0130876 A1 * 5/2013 Man ..... A63B 21/4045 482/142
2013/0331243 A1 * 12/2013 Walkama ..... A63B 21/0552 482/130
2014/0276273 A1 * 9/2014 Leismer ..... A63B 21/00178 601/49
2015/0328496 A1 * 11/2015 Eder ..... A63B 23/12 482/62
2015/0352394 A1 * 12/2015 Marti ..... A61B 5/6835 482/139
2016/0037925 A1 * 2/2016 Yen ..... A47C 4/00 297/325
2016/0114204 A1 * 4/2016 Swanson ..... A63B 21/4029 482/142
2016/0236027 A1 * 8/2016 Bastyr ..... A63B 23/03575
2017/0001064 A1 * 1/2017 Vorozilchak ..... A63B 21/4029
2017/0246496 A1 * 8/2017 Nelson ..... A63B 21/0783
2018/0028852 A1 * 2/2018 Beaver ..... A63B 21/078
2018/0099176 A1 * 4/2018 Specht ..... A63B 21/4029
2018/0117382 A1 * 5/2018 Johanson ..... A63B 21/00047
2018/0140883 A1 * 5/2018 Tsui ..... A63B 71/0054
2018/0228682 A1 * 8/2018 Bayerlein ..... A61H 1/0274
2018/0339185 A1 * 11/2018 Miller ..... A61G 13/009
2019/0030389 A1 * 1/2019 Daravong ..... A63B 21/078
2019/0060699 A1 * 2/2019 Frederick ..... A63B 23/0405
2019/0126122 A1 * 5/2019 Vester ..... A63B 21/4029
2019/0240527 A1 * 8/2019 Hsieh ..... A63B 21/4029
2019/0262210 A1 * 8/2019 Rideout ..... A61H 1/0218
2020/0069066 A1 * 3/2020 Tse ..... A63B 23/04
2020/0069988 A1 * 3/2020 Gore ..... A63B 21/0628
2020/0069998 A1 * 3/2020 Smith ..... A61B 5/22
2020/0146456 A1 * 5/2020 Pritchard ..... A47C 7/503
2020/0391076 A1 * 12/2020 Zhao ..... A63B 23/16

* cited by examiner

MODULAR EXERCISE APPARATUS, SYSTEM, AND METHODS

RELATED APPLICATIONS

This application claims the benefit of and priority to U.S. Provisional Patent Application Ser. No. 62/749,120, filed Oct. 22, 2018, the disclosure of which is herein incorporated by reference in its entirety.

FIELD OF THE DISCLOSURE

The field of the disclosure relates generally to exercise equipment, and more specifically to a modular exercise apparatus and system for multi-functional use and performance.

BACKGROUND

Many conventional exercise apparatuses are designed for a user to perform a particular fitness exercise. Fitness studios and exercise gyms often maintain a significant amount of floor space to accommodate the multiple various separate devices that are devoted to each individual exercise. Some exercise apparatuses are designed for multi-functional use, but such multi-functional apparatuses typically represent an amalgamation of several separate devices that are joined together and require a significant footprint of the studio/gym floor space. Other conventional exercise apparatuses obtain multi-functional capability within a smaller footprint, but often at the expense of the quality of the individual functional capabilities. Some exercise apparatuses are convertible from one type of device into another, but the conversion process is often time-consuming, difficult for the average user to easily perform, and may require special tools.

These challenges are particularly significant with respect to Pilates exercise equipment. Pilates is a generic term that is commonly used to refer to a physical fitness system named after Joseph Pilates, and for which several well-known types of exercise devices are often employed. Among these known Pilates devices are a Pilates chair, a Pilates high-back chair (sometimes referred to as a Pilates electric chair), a Pilates tower, and Pilates reformer. The Pilates chair and the Pilates reformer typically constitute the foundational exercise equipment of a Pilates studio. These apparatuses, however, are relatively large, and smaller studios are limited in their ability to accommodate multiple apparatuses, or a variety of different apparatuses.

Some conventional solutions have integrated two different Pilates apparatuses together. For example, conventional Pilates chairs have been designed that convert into high-back Pilates chairs. However, one such convertible apparatus merely fixes a back panel onto a standard Pilates chair. This seat portion of this converted Pilates chair is the same depth with the attached back panel as it is without. Another such convertible apparatus provides a seat-and-back top cover that fits over the seat portion of the standard Pilates chair, fixed to the side panels thereof. The top cover, however, does not integrate with the Pilates chair seat portion, but instead completely covers the seat with its own seat portion, and does not allow any adjustability thereof.

Another conventional solution integrates a Pilates tower into a standard Pilates high-back chair. These conventional integrated tower/high-back chair combinations, however, typically require that the high-back chair portion be fixedly secured to the ground (similar to a standard Pilates tower) to prevent the assembly from tipping when vertical forces are applied to the tower portion. Such fixed attachments render it very difficult to conveniently move the assembly to different locations as desired. Additionally, the tower portion of conventional tower/high-back chair combination assemblies are known to experience a significant amount of play with respect to the high-back chair portion, that is, the tower portions are known to wiggle somewhat in relation to the chair portion when pulling forces are exerted against the tower according to known Pilates exercise routines.

Lastly, the majority of Pilates exercise apparatuses have been manufactured according to substantially the same standard design for several decades. This standard design includes solid side panels for the Pilates chair (typically made of heavy wood) and solid back panels for the Pilates high-back chair. Even when disassembled, this standard design is a very heavy and bulky to ship from one location to another. This standard design also makes customization difficult without significant expense.

Accordingly, an improved exercise apparatus design is needed for integrating multi-functional capability into a single system, which uses a significantly smaller footprint, while also providing the same quality to each individual component that would be experienced using an apparatus having only the functionality of that single component.

SUMMARY

In an embodiment, an exercise system includes a base module having a seat with a seat depth, and a vertically adjustable back configured to fixedly engage with the base module at a first seat depth and a second seat depth different from the first seat depth.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, and such ranges are identified and include all the sub-ranges contained therein unless context or language indicates otherwise.

Throughout the following description, like parts among the several drawings are labeled by the same numbering, for ease of explanation.

Figure 1A:
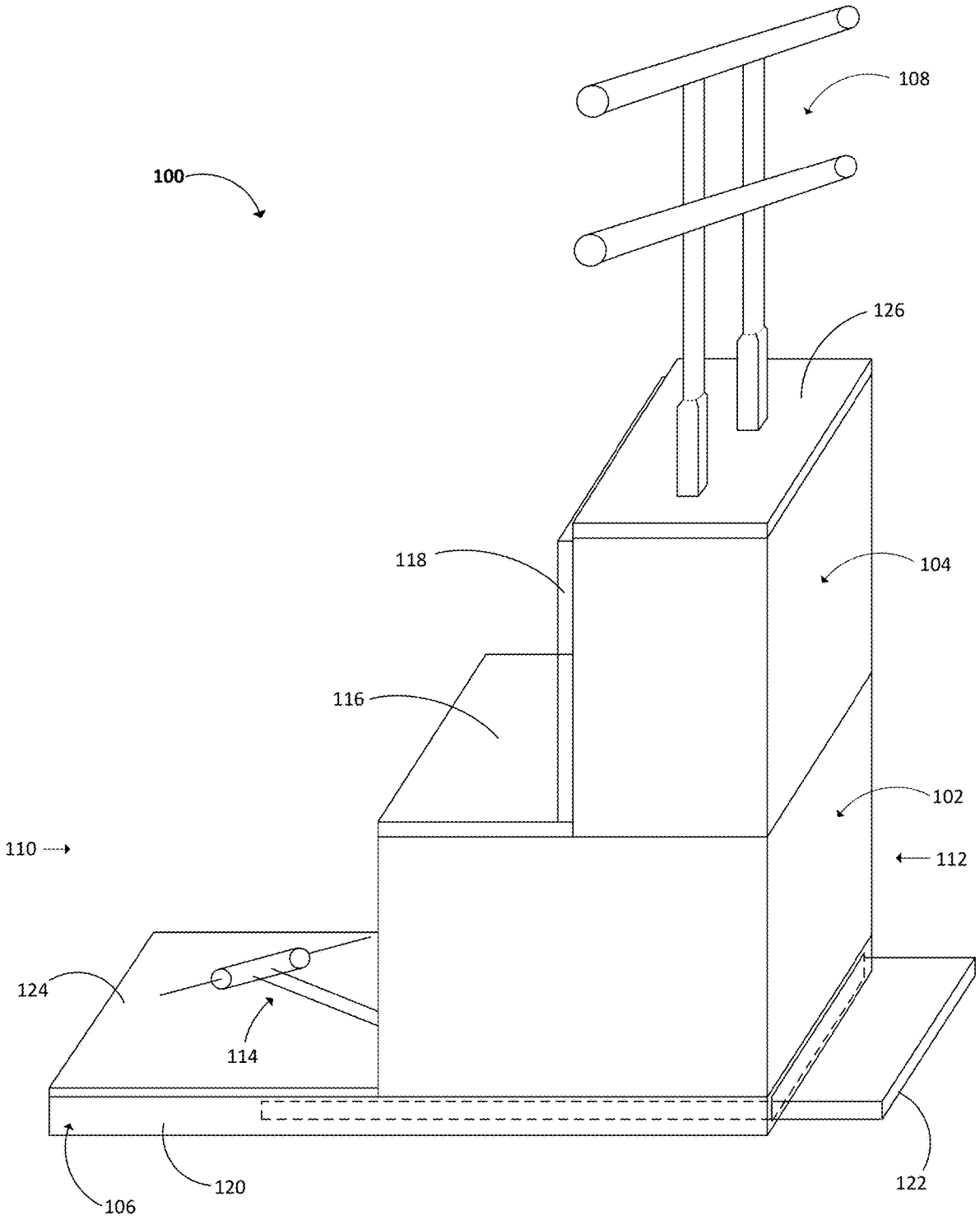
FIG. 1A is a perspective view of a modular exercise system, according to an embodiment.

FIG. 1A is a perspective view of a modular exercise system 100. In an exemplary embodiment, modular exercise system 100 includes a base module 102, a back module 104, a platform module 106, and a tower module 108. Modular exercise system 100 is particularly useful, for example, with various fitness exercises, and particularly for Pilates-based physical exercises. As described further herein, and for ease of explanation, the various components of modular exercise system 100 are described with respect to a front end 110 and a rear end 112.

In an embodiment, base module 102 is configured to function, with or without the other components of system 100, as a Pilates chair, includes a foot paddle unit 114 and a first seat pad 116. Similarly, back module 104 may include a back rest 118. As described further below, some of the components of system 100 are operably functional without inclusion of other components. In the exemplary embodiment, platform module 106 includes a front stabilizer portion 120, a rear stabilizer portion 122, and a platform cover 124. Where platform module 106 is implemented, rear stabilizer portion 122 may be movable, and operably nested within front stabilizer portion 120 and under platform cover 124. Where tower module 108 is implemented, back module 104 may further include a tower mating unit 126.

Figure 1B:
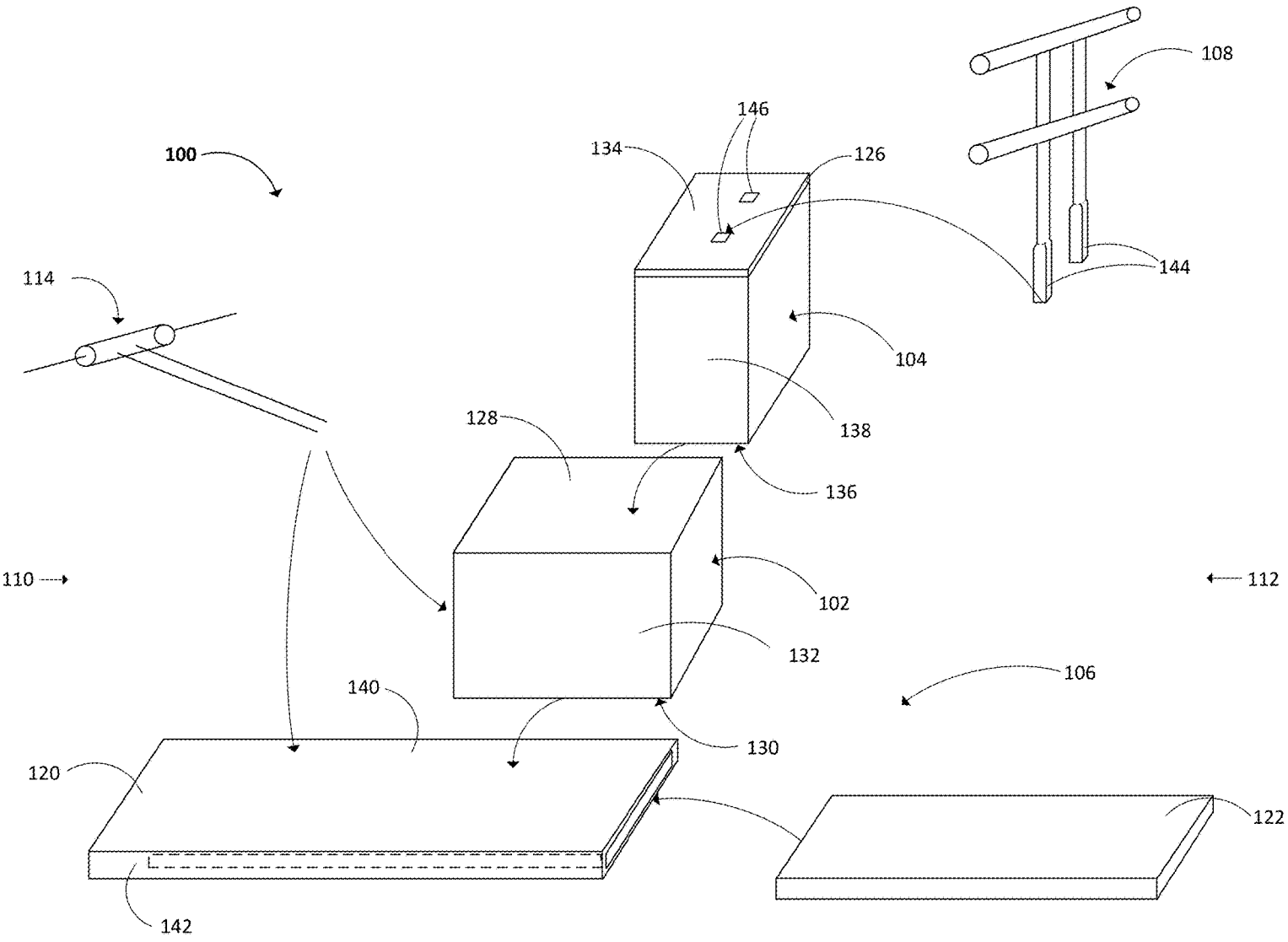
FIG. 1B is an exploded view of the modular exercise system depicted in FIG. 1A.

FIG. 1B is an exploded view of modular exercise system 100, FIG. 1A. In the exploded view, additional details of the several components may be seen. For example, base module 102 includes a base top 128, a base bottom 130, and two opposing base sides 132. Similarly, back module 104 includes a back top 134, a back bottom 136, and two opposing back sides 138.

When integrated together, back bottom 136 of back module 104 is coupled to base top 128 of base module 102, towards rear end 112. In in at least one embodiment, back module 104 is coupled to base module 102 such that the two modules are flush at rear end 112. As described further below with respect to FIGS. 2A-B, back module 104 is optionally configured to be horizontally adjustable across base top 128 at different fixed positions. In some embodiments, back module 104 is entirely removable from base module 102, such that base module 102 may operate as a standard Pilates chair.

Platform module 106 includes a platform top 140 and two opposing platform sides 142. In an embodiment, base bottom 130 of base module 102 is coupled to platform top 140 at rear end 112 as separate modules. In at least one embodiment, base bottom 130 is integrally constructed with platform top 140 as a single unit (described further below with respect to FIG. 3F).

In an exemplary embodiment, tower module 108 of modular exercise system 100 is integrally coupled to back module 104 to be securely positioned above back top 134. In this example, tower mating unit 126 is disposed at back top 134, and tower feet 144 of tower module 108 enter through tower mating unit 126 at tower openings 146, thereby allowing tower feet 144 two extend through back top 134 into back module 104.

In one embodiment, first seat pad 116 may be coupled to base top 122 towards forward end 110 of base module 102 and extending towards rear end 112. First seat pad 116 extends toward rear end 112 up to back module 104; however, first seat pad 116 may cover other lengths of the top of base module 102 and, when exercise system 100 does not include back module 104, first seat pad 116 may cover part of or all of base top 128. Additionally, back rest 118 of back module 104 may couple to back sides 138 facing forward end 110. In some embodiments, back rest 118 may cover all or part of the back side 138 facing forward end 110. A top back board 154 may be coupled to back top 134 of back module 104, under tower mating unit 126. In some embodiments, tower mating unit 126 may cover all or part of back top 134. Similarly, platform cover 124 may cover all or part of platform top 140. In some embodiments, platform cover 124 covers only the portion of platform module 106 that extends forward of base module 102. In other embodiments, platform cover 124 extends the entire length of platform module 106, or may be custom fit to accommodate various additional components, as described in greater detail below.

Figure 2A:
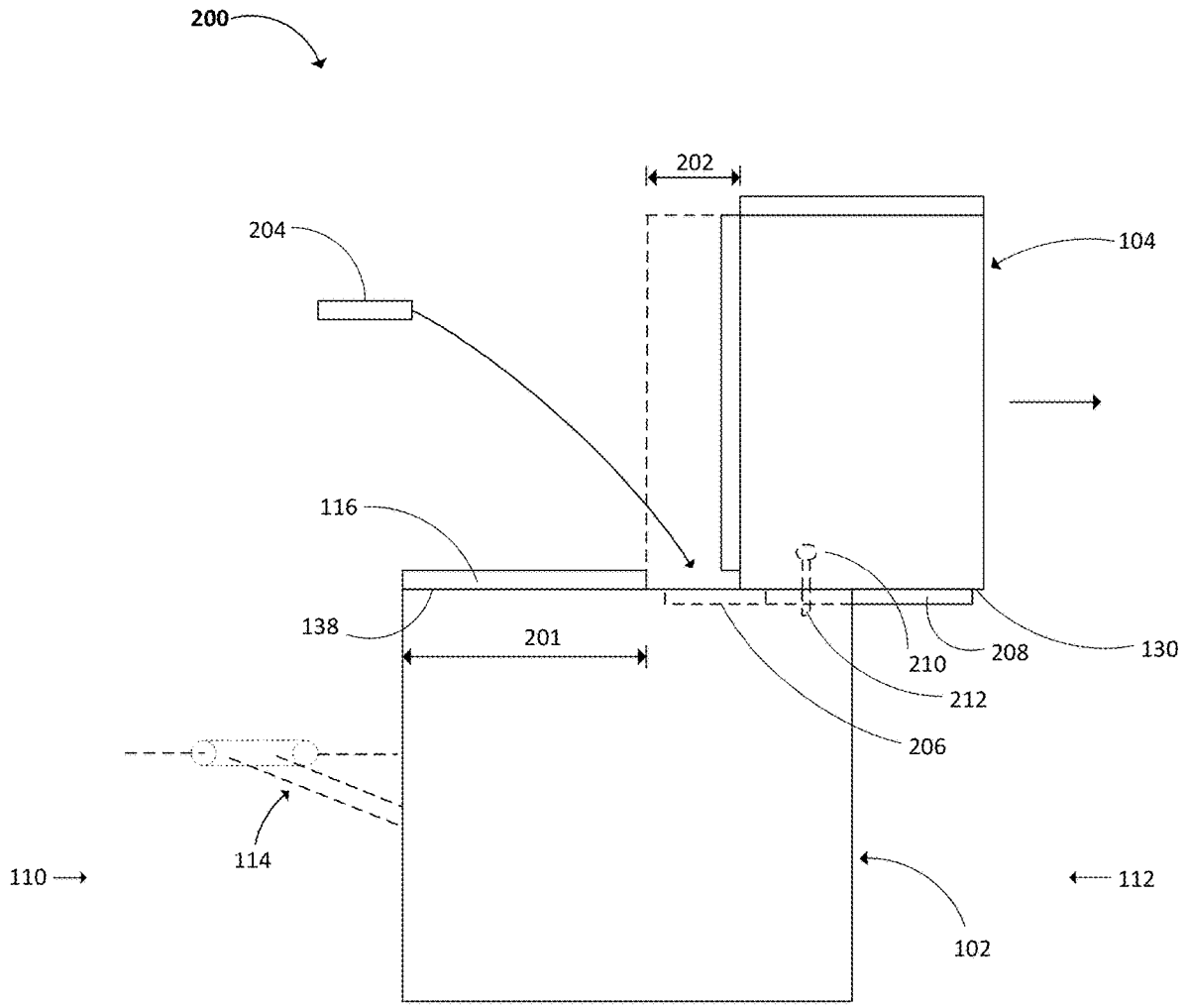
FIG. 2A is a side view of an adjustable high-back chair formed of the base module and the back module of the modular exercise system depicted in FIG. 1A, illustrating an operational adjustability between the respective components, according to an embodiment.

FIG. 2A is a side view of an adjustable high-back chair 200 formed of base module 102 and back module 104 of modular exercise system 100, FIG. 1A, illustrating an operational adjustability between the respective components. In exemplary operation of high-back chair 200, a user sits on first seat pad 116 facing toward front end 110, with the user's back against back rest 118. In this position, the user's legs are positioned toward foot paddle unit 114 (e.g., with legs bent), enabling the user to press down on foot paddle unit 114 with their feet to perform leg exercises (i.e., utilizing a resistance element or spring of foot paddle unit 114, described further below).

However, as described above, conventional high-back chairs have only a single depth to the seat portion between the front end of the chair and the back rest. These high-back chairs are unable to accommodate users having longer legs, or of wider girth in the case where a user performs sideways exercises (described further below with respect to FIG. 2B). High-back chair 200 advantageously overcomes this obstacle by configuring back module 104 to be horizontally adjustable in a direction A with respect to base module 102. More specifically, back module 104 is horizontally adjustable toward rear end 112 of base module 102, but while keeping back rest 118 substantially perpendicular over a range of horizontal adjustability.

In an exemplary embodiment, back module 104 is fixedly coupled to base module 102 at a first seat depth 201. In exemplary operation, back module 104 may be freed from a fixed coupling with base module 102, and slidably moved in direction A over a seat extension depth 202, at which position, back module 104 may also be fixedly coupled to base module 102. In at least one embodiment, when back module 104 is positioned to seat extension depth 202, a second seat pad 204 may be placed on base module 102 between first seat pad 116 and back module 104 such that part or substantially all of seat extension depth 202 is covered by second seat pad 204. In these examples, first and second seat pads 116, 204 may consist of a solid material suitable for supporting weight, such as, but not limited to, wood, plastic or metal. Additionally, in some further embodiments, filler seat board 204 may be coupled to other materials, such as, but not limited to, fabric and/or padding material.

In an exemplary embodiment, back module 104 engages with base module 102 by the mating of one or more grooves 206 into one or more respective runners 208 configured to matingly couple with grooves 206. In some embodiments, the coupling of runners 208 into grooves 206 is configured to form a tight fit such that back module 104 is secure above base module 102, but does not experience play from various forces exerted against the several components. In in an embodiment, back module 104 is additionally, or alternatively, coupled to base module 102 by one or more fasteners 210 that extend vertically through back bottom 136 and engage with fastening means 212 disposed within or opposite back top 134. Fasteners 210, for example, may include screw threads to mate with corresponding threading of fastening means 212, to allow for repeated engagement and disengagement of back module 104 to and from base module 102. One, both or other similar configurations may be used to secure back module 104 to base module 102 when the back module is shifted to additional seat depth 202.

Figure 2B:
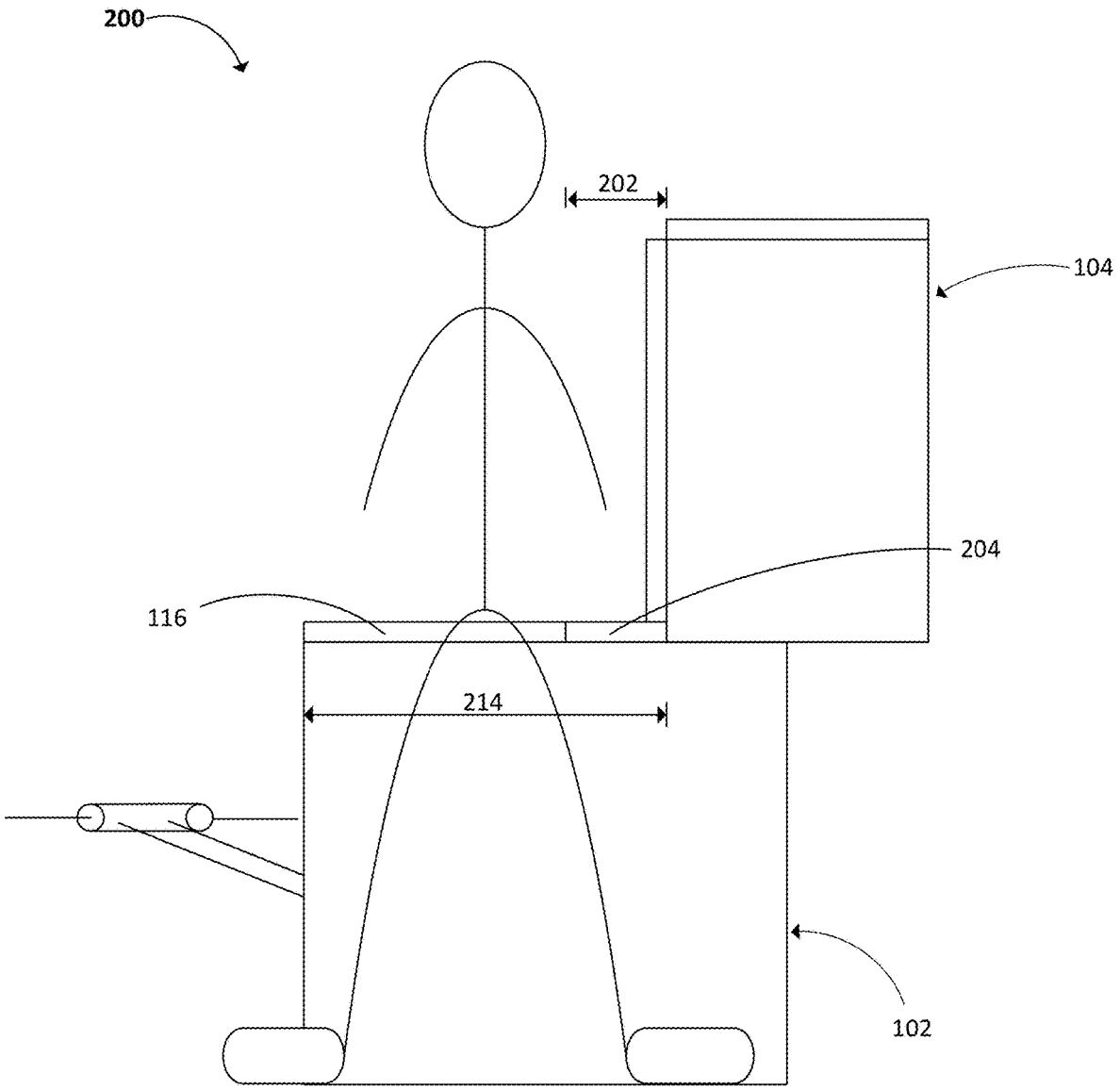
FIG. 2B illustrates an operational principle of the embodiment depicted in FIG. 2A.

FIG. 2B illustrates an operational principle of the embodiment depicted in FIG. 2A. In an alternative implementation of adjustable high-back chair 200, a user sits sideways, with one arm directed toward front end 110, and the other arm directed toward rear end 112, such as in the case where foot paddle 114 is used for arm exercises. The conventional one-size-fits-all high-back chairs are only able to accommodate users up to a certain user with, i.e., up to first seat depth 201. Users having a wider girth are generally prevented from using the conventional high-back chair for such exercises.

According to the innovative features of high-back chair 200 though, back module 104 is adjustable from first seat depth 201 to a second seat depth 214. In the exemplary embodiment, second seat depth 214 is illustrated to represent a fixed position; however, a second seat depth 214 may also represent a range of available depths to which back module 104 may be smoothly adjusted and fixed. That is, when back module 104 is horizontally adjusted, a user is provided with additional depth to sit on base module 102. The user, for example, may lean on foot paddle unit 114 with one arm and press down to engage oblique muscles and other muscles. Adjustable high-back chair 200 is therefore particularly useful for larger individuals who are not able to use standard conventional Pilates exercise equipment. In at least one embodiment, back module 104 may be entirely removed from base module 102, and second seat pad 204 may be alternatively configured to cover the entire base top 128 beyond first seat pad 116. In some embodiments, second seat pad 204 may be a plurality of second seat pads configured to cumulatively accommodate increasing discrete second seat depths 214.

Figure 3A:
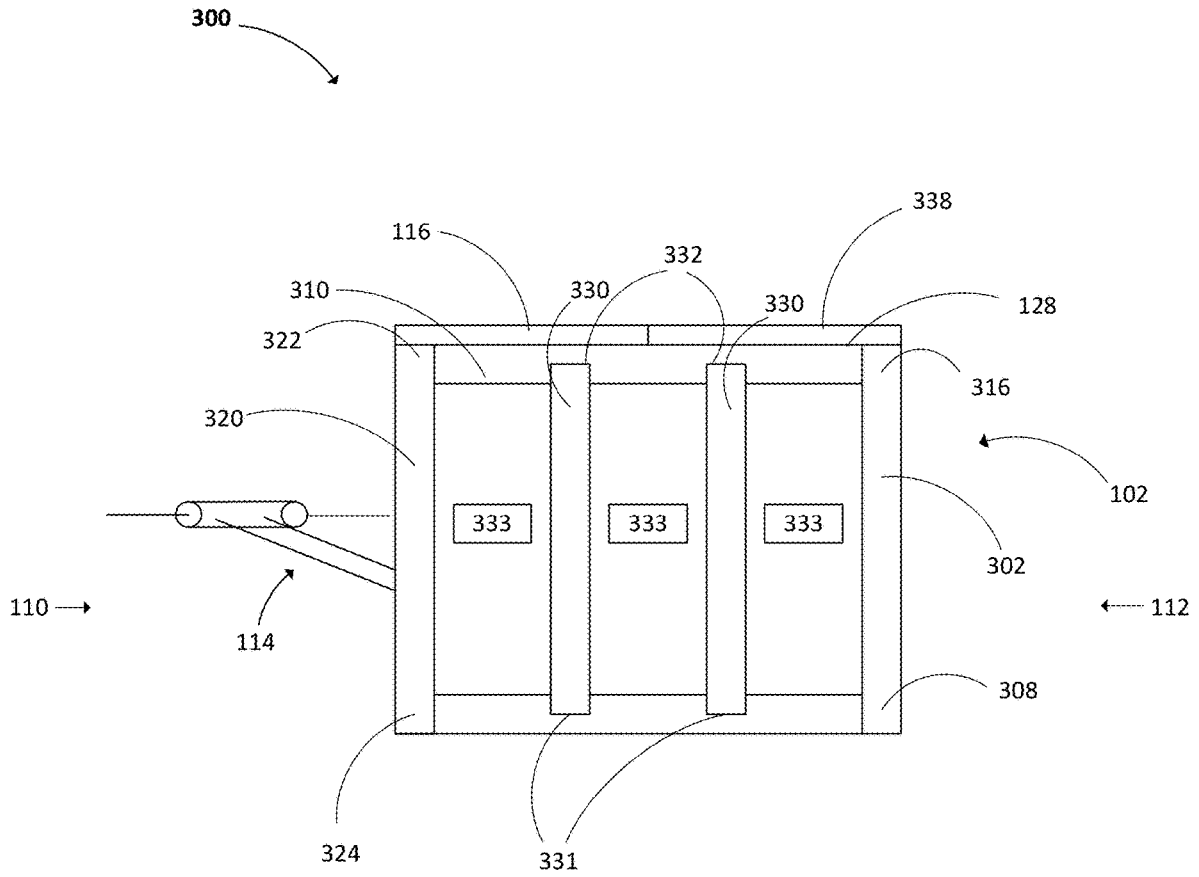
FIG. 3A is a side view of the base module depicted in FIG. 1A, illustrating an exemplary structural framework.
Figure 3B:
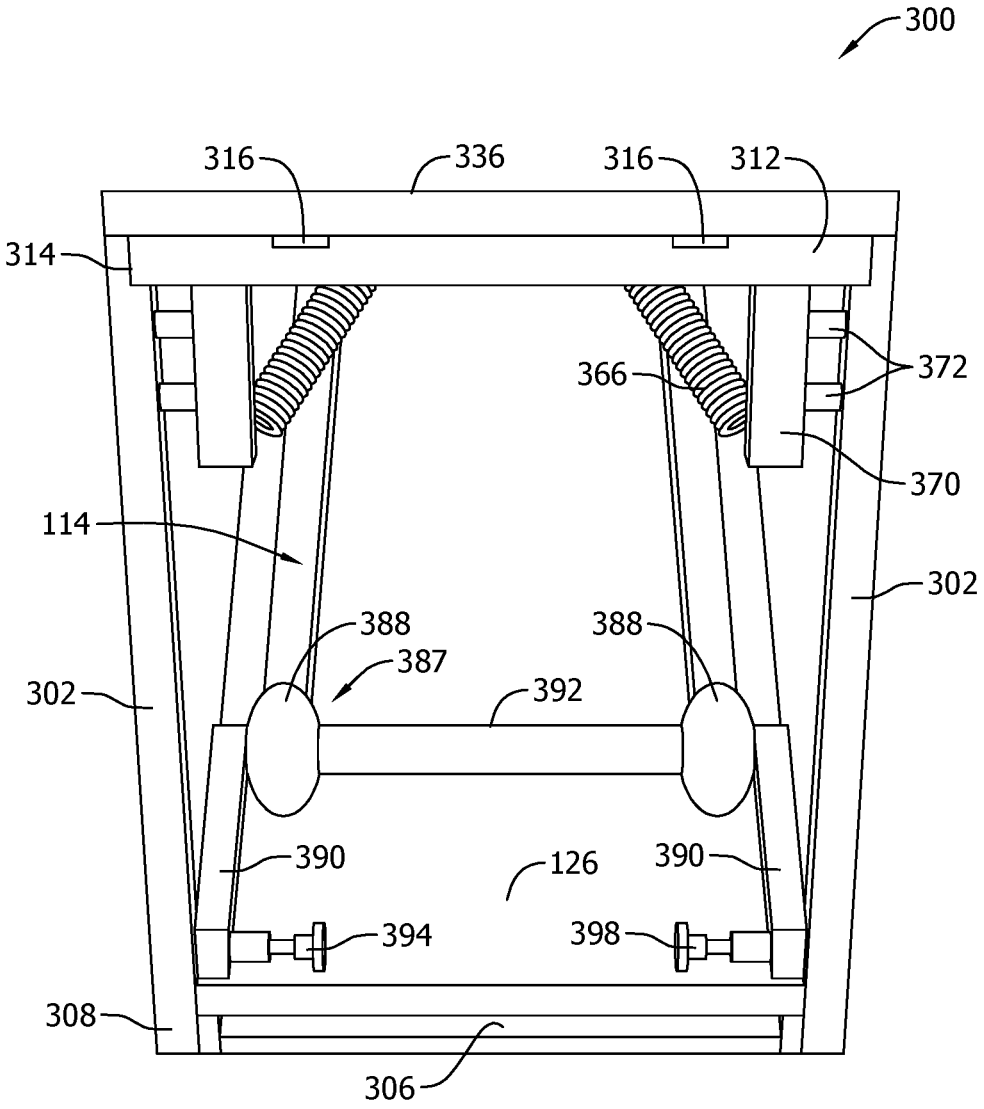
FIG. 3B is a rear perspective view of the base module depicted in FIG. 1A, according to an embodiment.
Figure 3C:
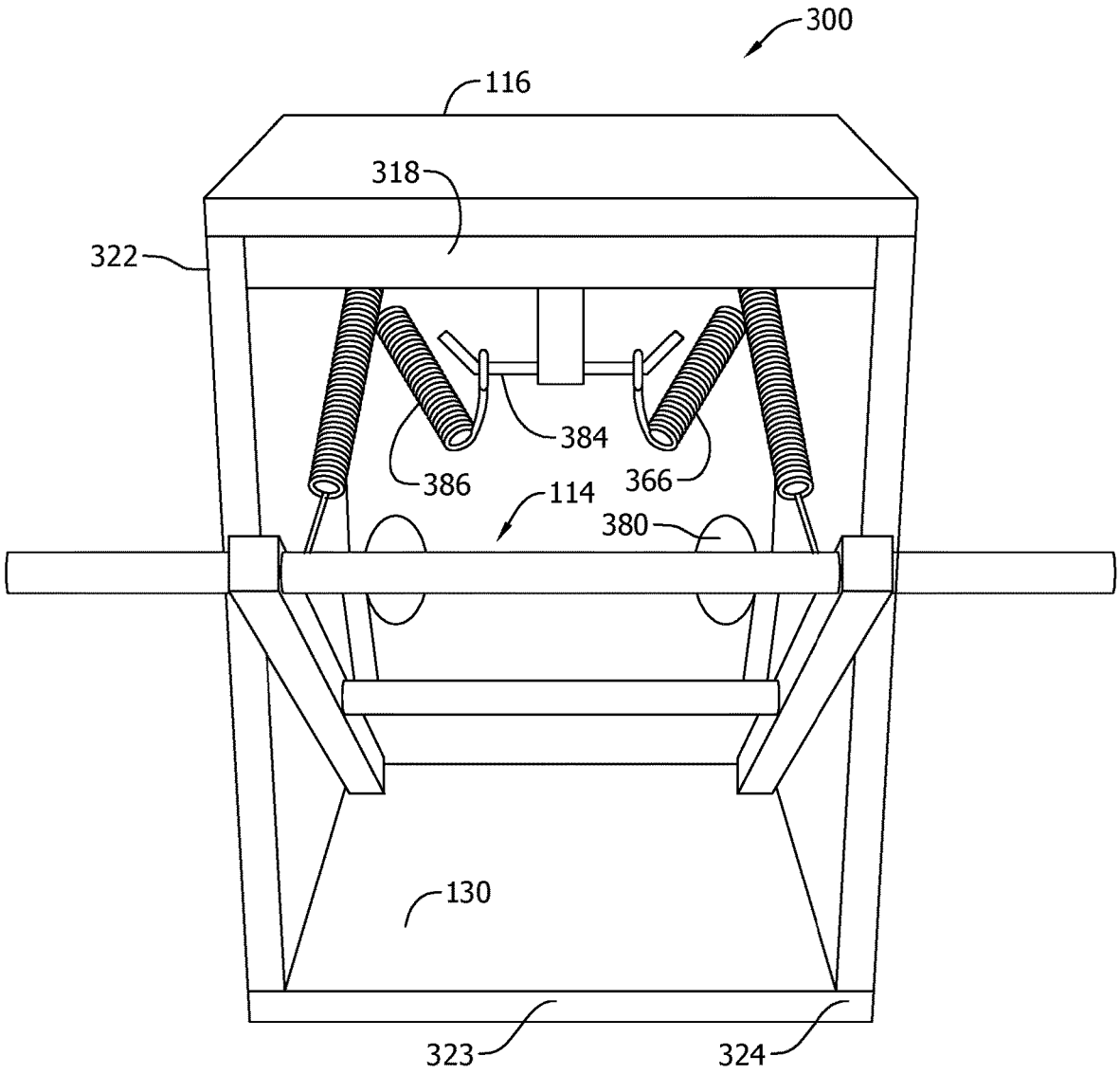
FIG. 3C is a front perspective view of the base module depicted in FIG. 1A, according to an embodiment.
Figure 3D:
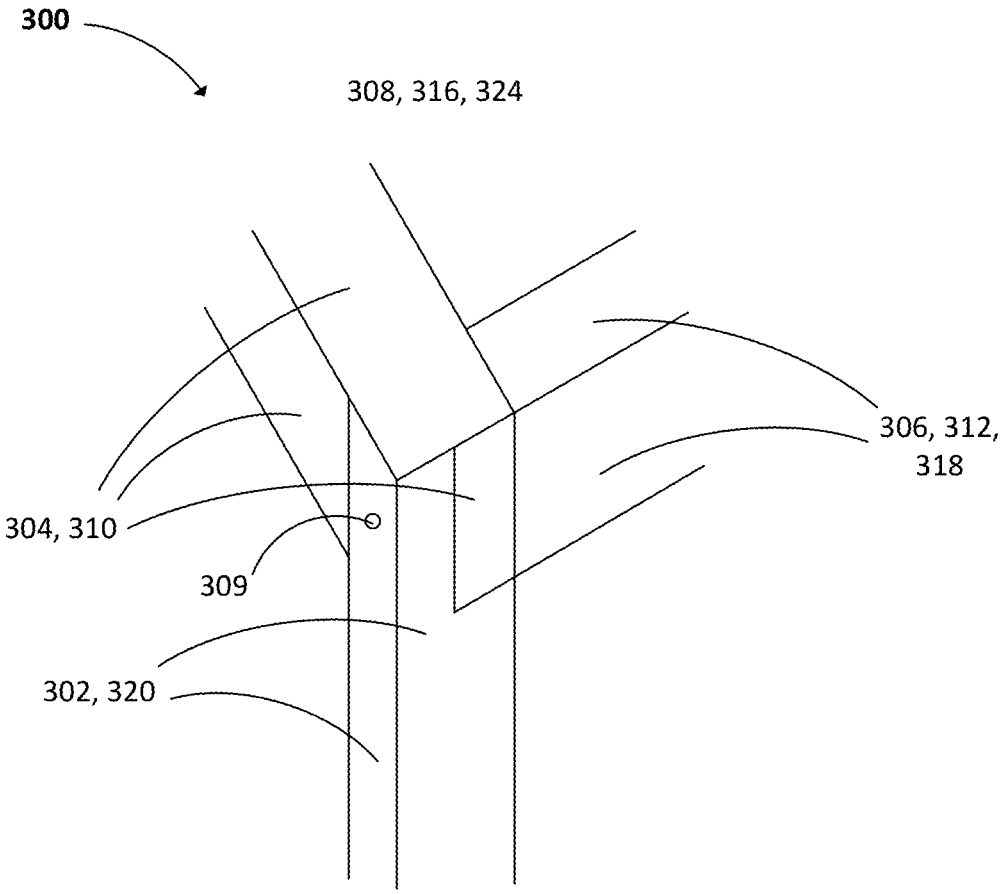
FIG. 3D is a partial view of a portion of the structural framework depicted in FIG. 3A, according to an embodiment.
Figure 3E:
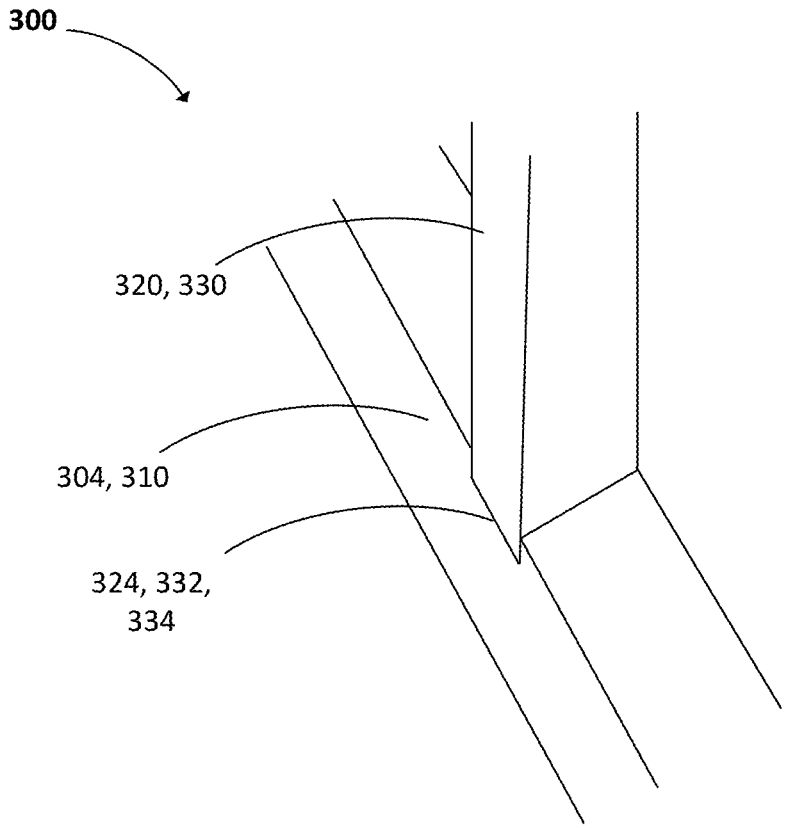
FIG. 3E is a partial view of another portion of the structural framework depicted in FIG. 3A, according to an embodiment.
Figure 3F:
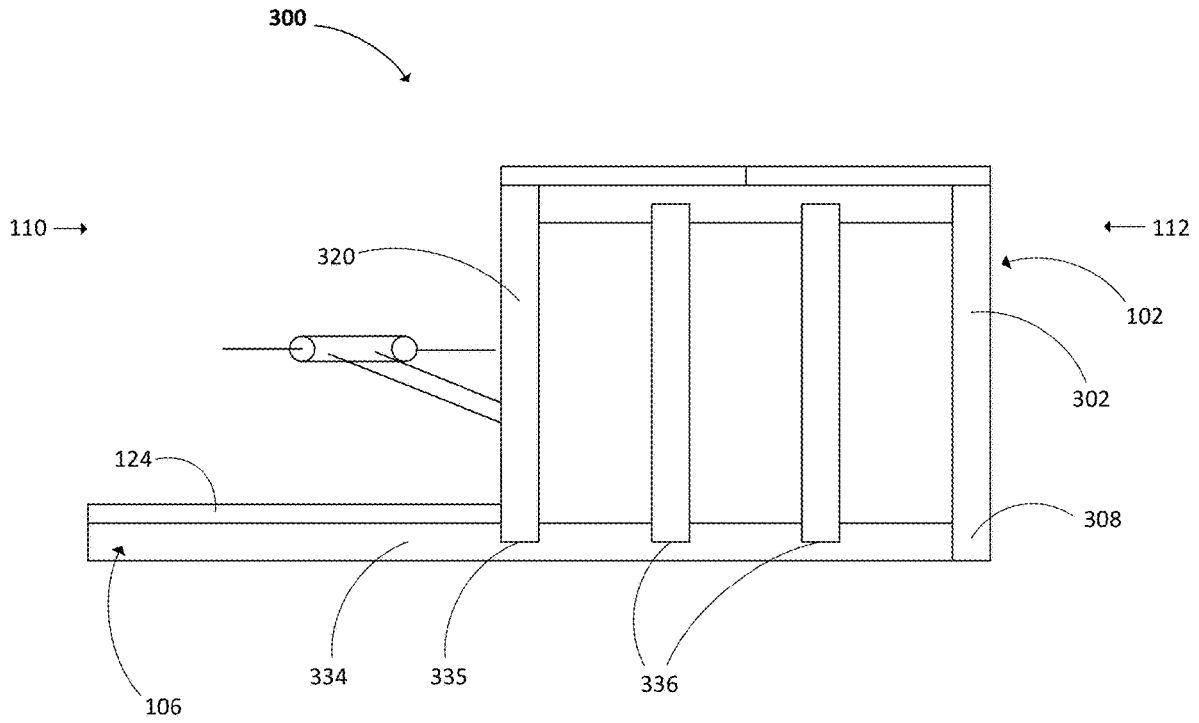
FIG. 3F is a side view of the base module and the platform module of the modular exercise system depicted in FIG. 1A, according to an embodiment.
Figure 3G:
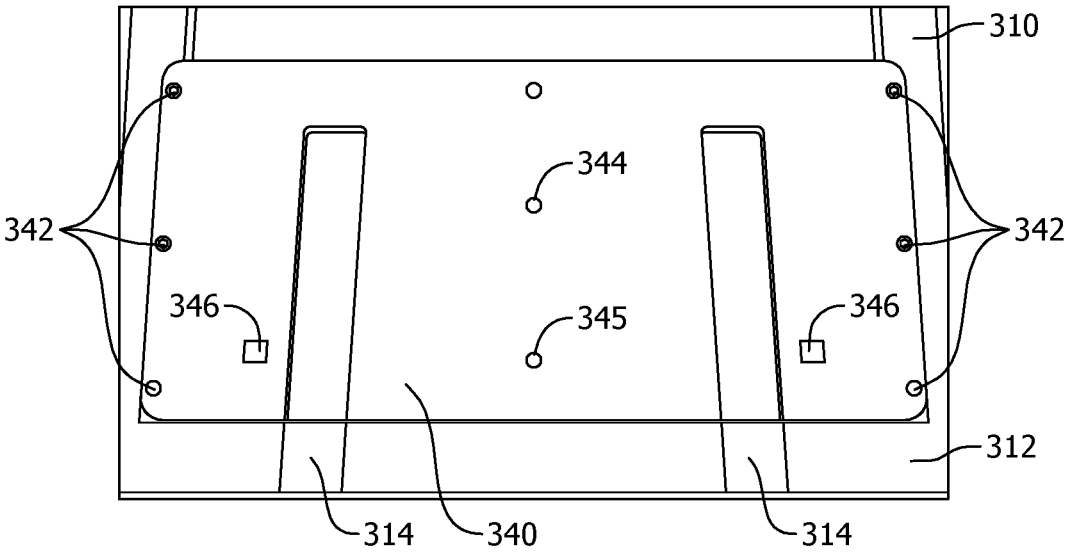
FIG. 3G is a top view of the base module depicted in FIG. 1A, according to an embodiment.
Figure 3H:
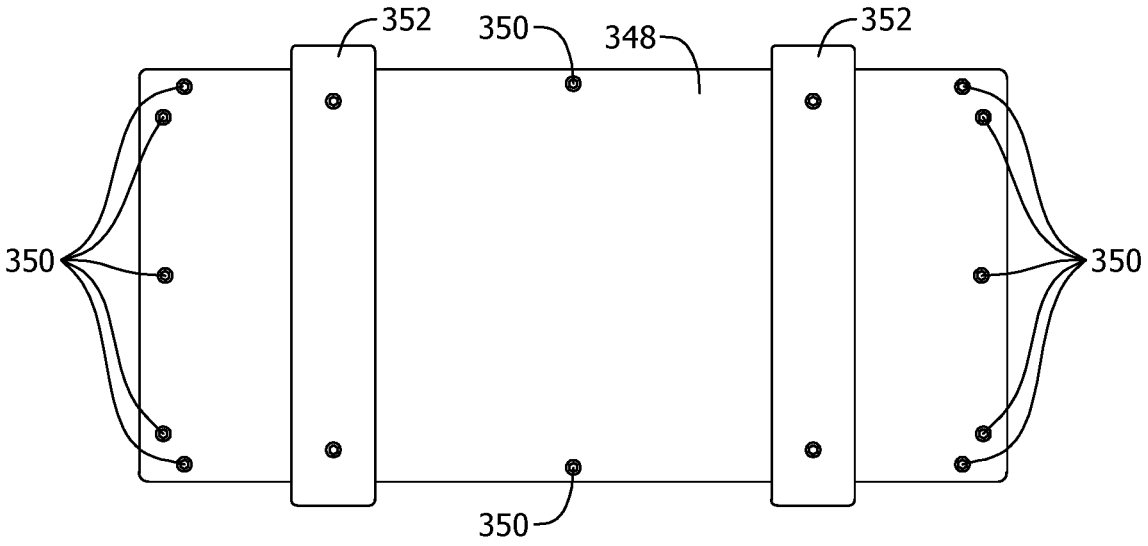
FIG. 3H is a bottom view of the back module depicted in FIG. 1A, according to an embodiment.
Figure 3I:
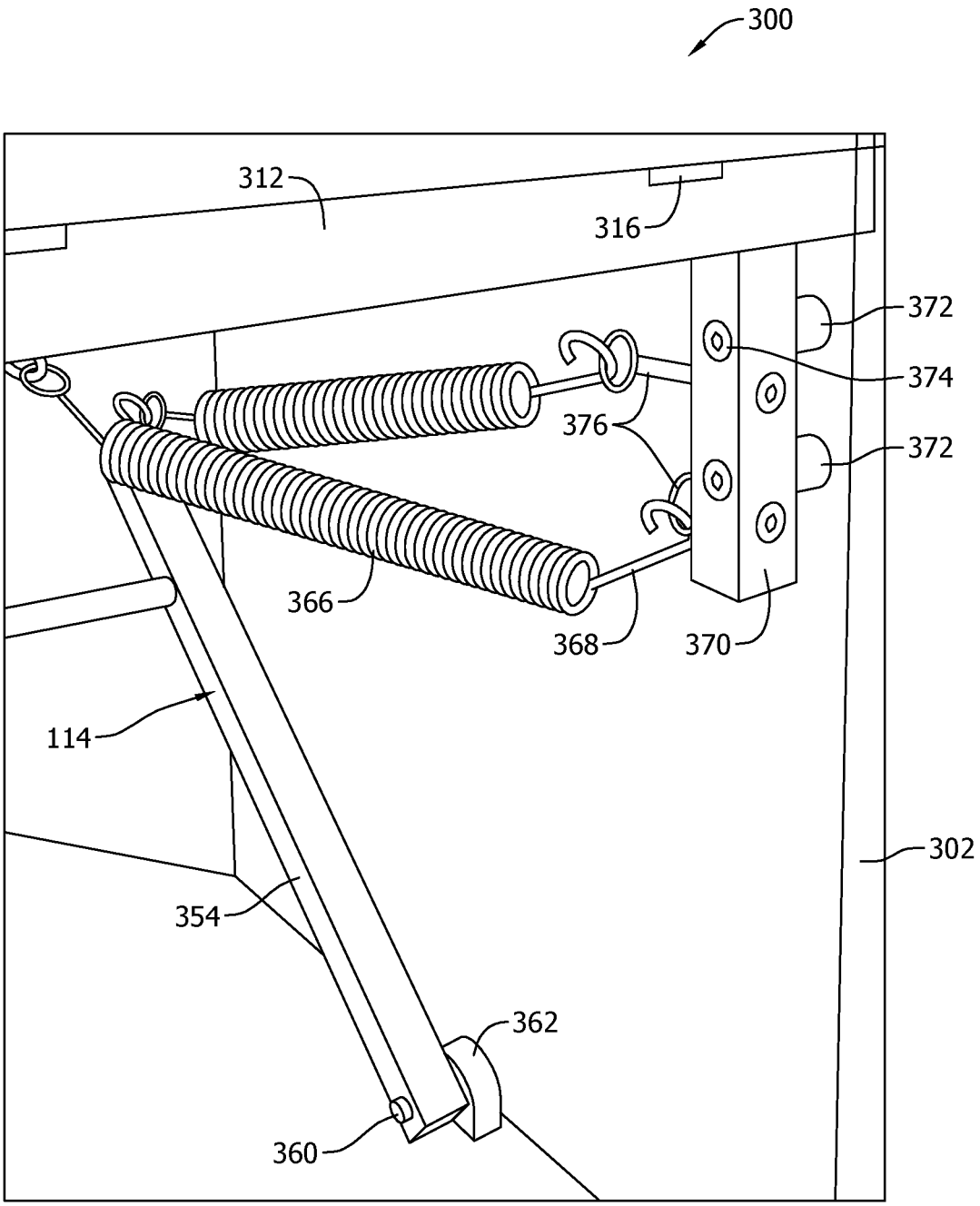
FIG. 3I is a partial perspective view illustrating internal components of the base module depicted in FIG. 1A, according to an embodiment.
Figure 3J:
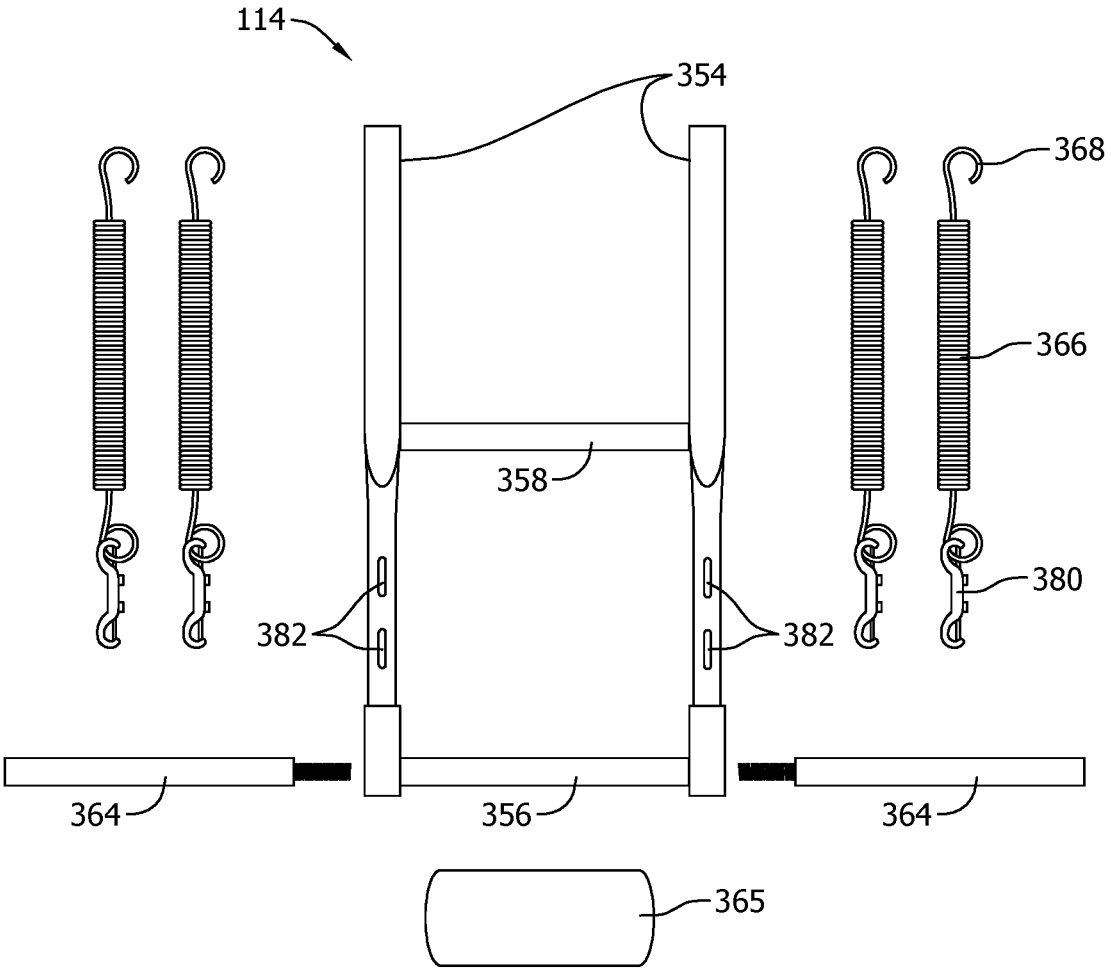
FIG. 3J is an exploded view of the foot paddle unit of the base module depicted in FIG. 1A, according to an embodiment.
Figure 3K:
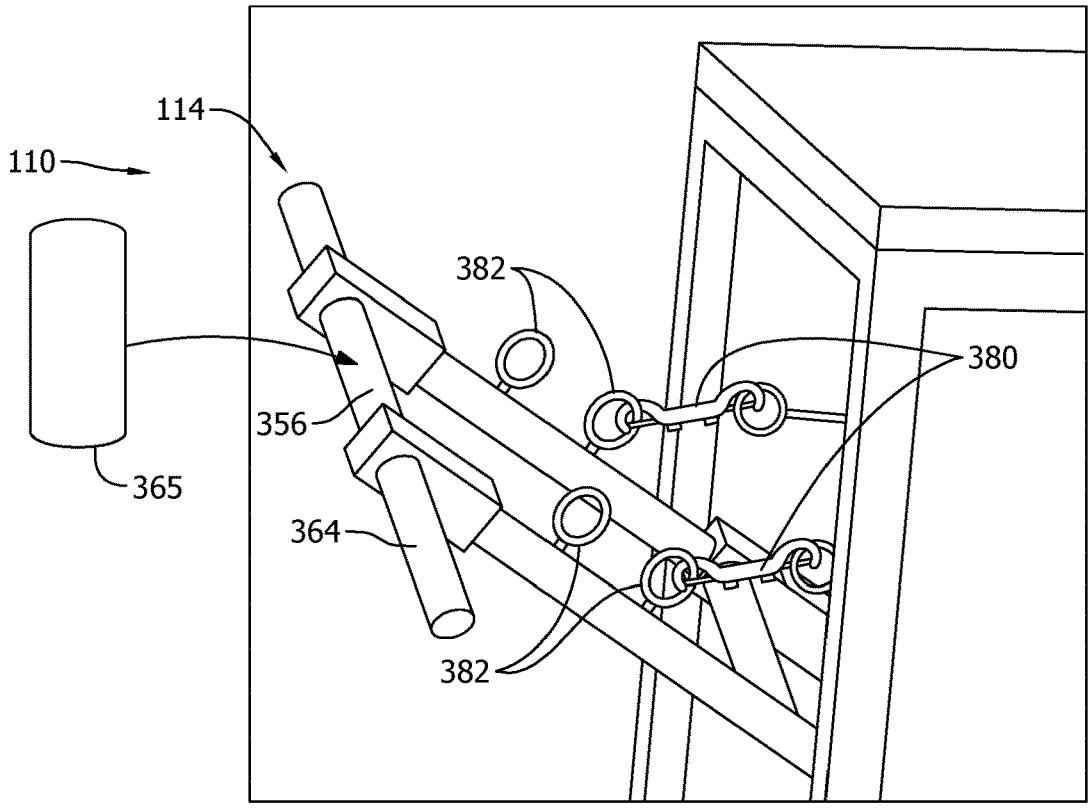
FIG. 3K is a perspective view illustrating an operational relationship of the foot paddle and the base module depicted in FIG. 1A, according to an embodiment.
Figure 3L:
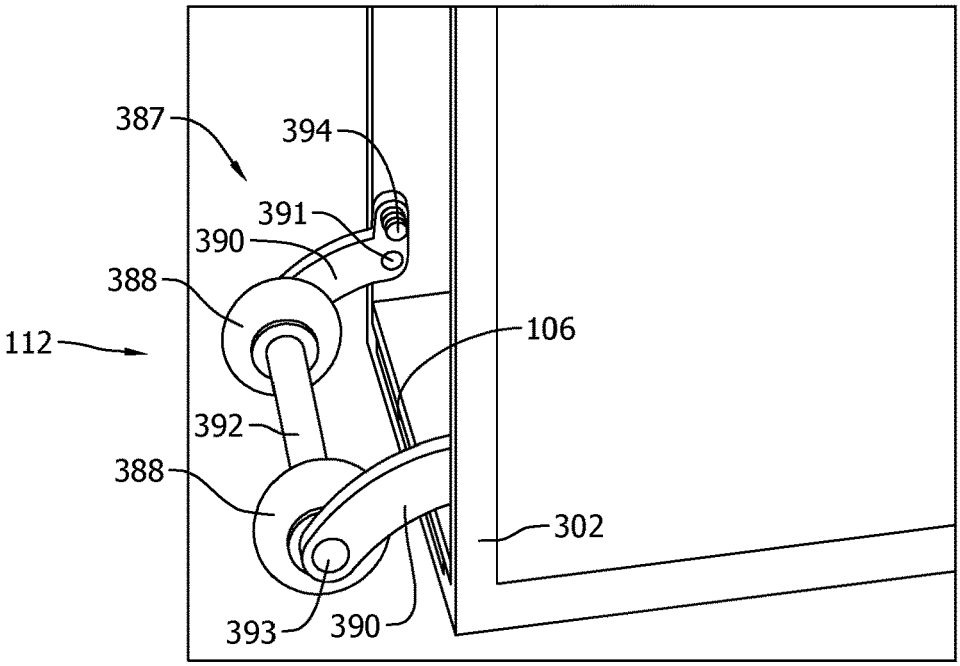
FIG. 3L is a partial perspective view of the base module depicted in FIG. 1A, according to an embodiment.
Figure 3M:
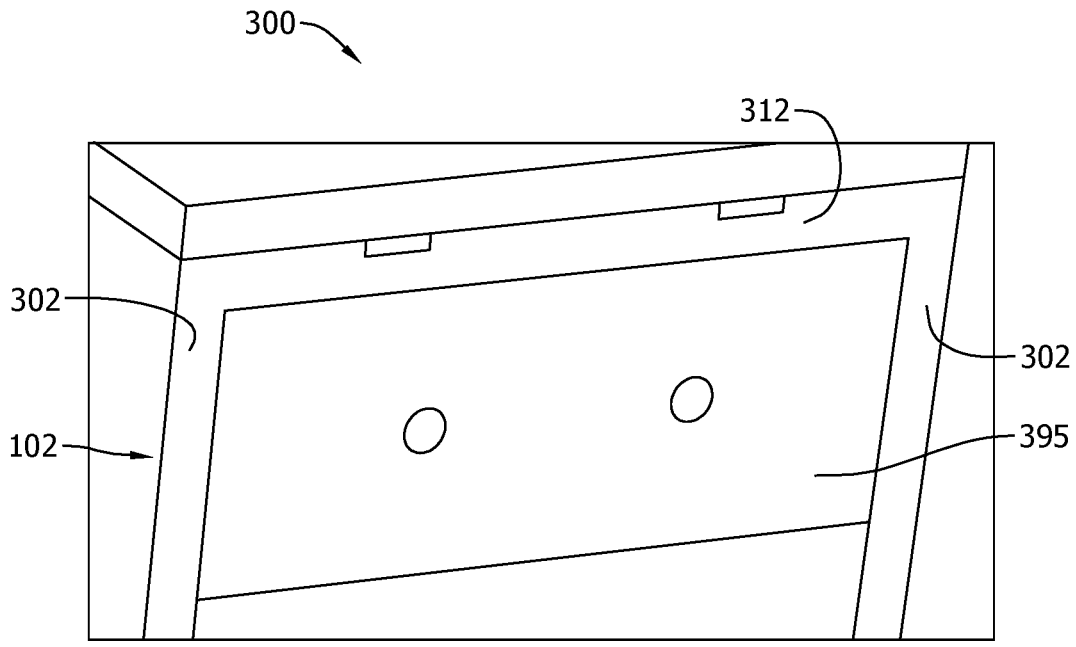
FIG. 3M is a rear partial perspective view of the base module depicted in FIG. 1A, according to an embodiment.
Figure 3N:
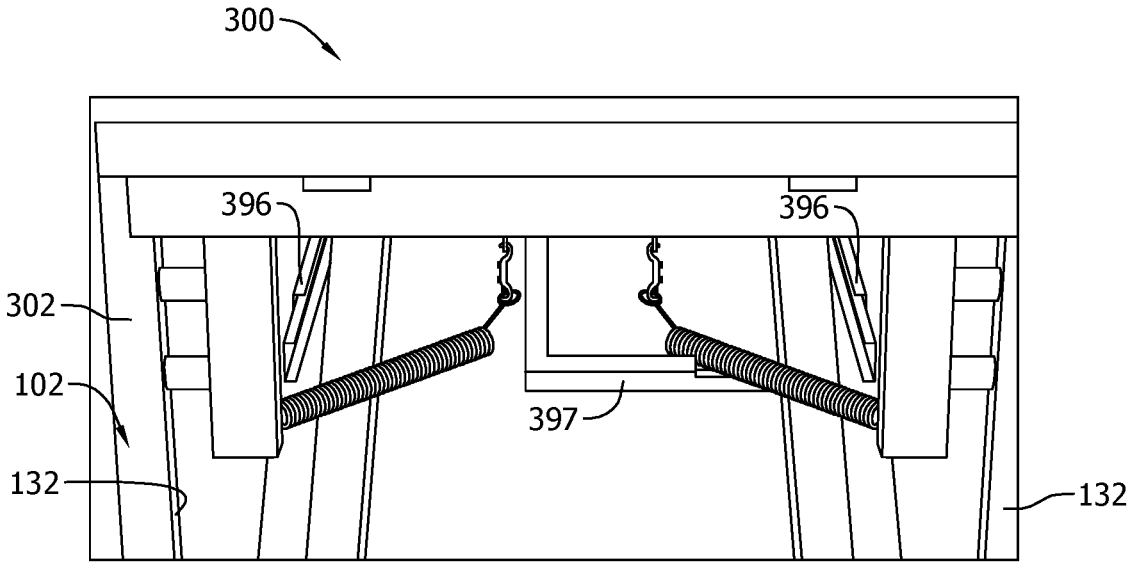
FIG. 3N is a front partial perspective view illustrating additional internal components of the base module depicted in FIG. 1A, according to an embodiment.
Figure 3O:
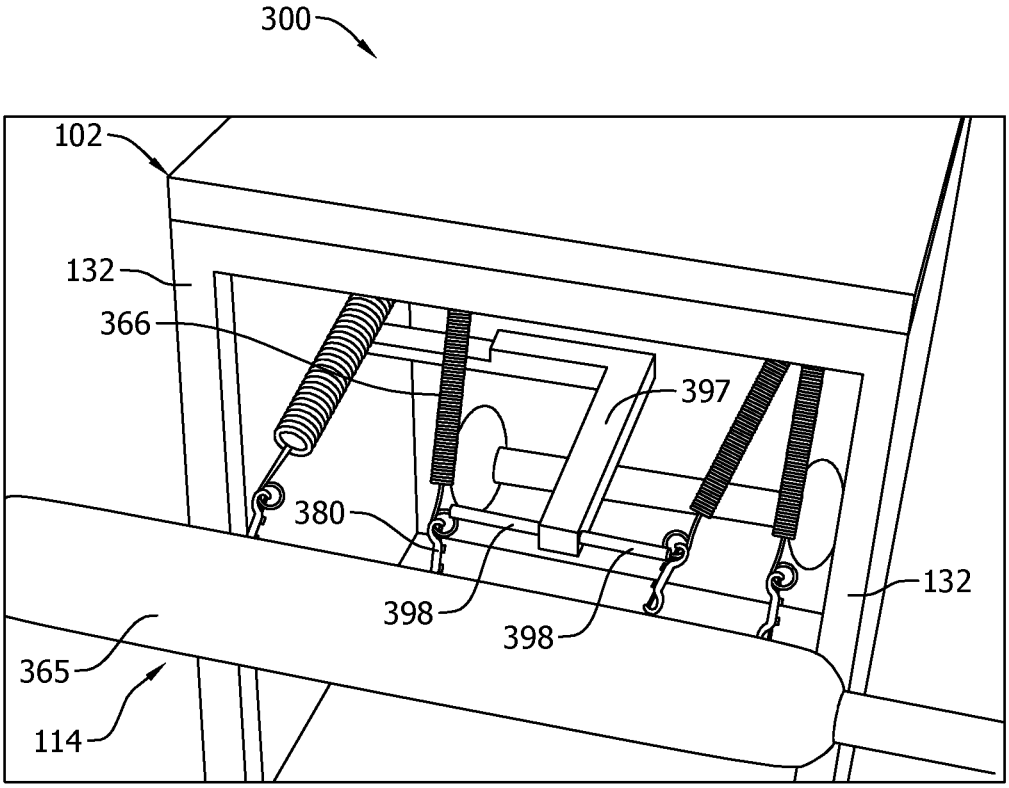
FIG. 3O is an additional front partial perspective view of the embodiment depicted in FIG. 3N.

FIGS. 3A-3O illustrate several views, embodiments, and details of base module 102, both alone, and coupled with platform module 106 in some instances. FIG. 3A is a side view of base module 102, FIG. 1A, illustrating an exemplary structural framework 300. Structural framework 300 advantageously provides easy assembly and disassembly of the modular exercise system 100 for both efficient shipping, and to provide a flexible construction design that easily lends itself to customization.

In an exemplary embodiment, framework 300 includes vertical rear base bars 302 (i.e., a pair of vertical rear base bars 302 on either opposing side of base module 102), side base bars 304, lower rear base bar 306, and lower rear base connection points 308. Rear base bars 302 extend vertically from connection points 308 and connect at base top 128 to a side seat bar 310 and a rear seat bar 312 at rear seat connection points 314 in the same manner as connection point 308. Structural framework 300 of base module 102 thus provides significant structural integrity two base module 102 throughout the variety of intended uses thereof, but while substantially reducing the weight of the overall structure that is typically seen with conventional Pilates chairs that employ, for example, solid wood panels. The versatility of framework 300 further enables a variety of construction design configurations according to weight tolerances and aesthetic considerations. For example, additional vertical base bars 330 may be perpendicularly coupled between side seat bars 310 and side base bars 304 for additional structural integrity.

In in an exemplary embodiment, the structural components of base module 102, back module 104, and platform module 106 may be fabricated primarily from a metal, such as, but not limited to, aluminum or an aluminum alloy. In some embodiments, other portions of system 100 may be formed from continuous metal sheets (or what if desired) and/or may contain additional discrete metal bars providing structural support for the several separate modules 102, 104, 106, as described in greater detail below. As also described below, the innovative design of framework 300 enables particular adjacent modules to be integrally formed as a single unit, or separately detachable in a convenient manner as desired.

FIG. 3B is a rear perspective view of base module 102, FIG. 1A. In this example, base module 102 is illustrated to have a rectangular, cuboid shape, to enable easy modular interconnection, adjustability, and detachability. As seen in the rear perspective of FIG. 3B, opposing vertical rear base bars 302 are each coupled to two respective opposing side base bars 304 and to a lower rear base bar 306. In this configuration, vertical rear base bars 302 extend vertically from connection point 308 and side base bars 304 extend towards forward end 110 along base bottom 130.

FIG. 3C is a front perspective view of base module 102, FIG. 1A. As best seen from the front perspective, in some embodiments, base module 102 may further include a clip bar 384 extending down from a forward seat bar 318 towards base bottom 130. Clip bar 384 may contain one or more handle bars 386 and, in some embodiments, handle bars 386 may extend from clip bar 384 toward vertical forward base bar 320. According to this advantageous configuration, when foot paddle springs 366 are not attached to paddle eyebolts 382 (described further below with respect to FIGS. 3J-K), foot paddle clips 380 may alternatively be easily hooked to the one or more handle bars 386. By this configuration, minimal force applied to securely stow paddle springs 366 of the way, thereby preserving the elasticity of paddle springs 366 while also significantly improving the ability to easily stow and retrieve the springs.

FIG. 3D is a partial view of a portion of structural framework 300, FIG. 3A. In this embodiment, an exemplary joining of the respective bar components at connection point 308 is illustrated. That is, this example, the bar stock forming vertical rear base bar 302 may be configured to include right-angle chisel cutouts such that vertical rear base bar 302 mates with respective portions of the bar stock forming side base bar 304, forming substantially a right angle between therebetween. Further to this example, side base bar 304 is shown to also abut lower rear base bar 306 at connection point 308, thereby creating substantially right angles between all three bars 302, 304, 306. In an exemplary embodiment, a fastener 309 may fixedly join all three bars 302, 304, 306 together in a secure manner.

In an embodiment, rear seat bar 312 may include one or more grooves 316 in the upper portion thereof. Thus, from rear seat connection point 314, side seat bars 310 extend horizontally towards front end 110, in a substantially parallel manner with side base bars 304. Additionally, at front end 110, side seat bars 310 similarly join a forward seat bar 318 and two vertical forward base bars 320 at forward seat connection points 322. Furthermore, from forward seat connection points 322, vertical forward base bars 320 extend toward side base bars 304 and base bottom 130. At base bottom 130, vertical forward base bars 320 and side base bars 304 are coupled together, and also with lower forward base bar 323 at a base lower forward base connection point 324 in a manner similar to that described with respect to connection point 308.

In this example embodiment, the use of aluminum or other similar, light-weight metals, fixedly and securely joined together in the manner described above, creates a light-weight but sturdy structure for base module 102. Through the innovative structural design of framework 300, the individual manufactured components of the module may be more easily shipped then the conventional solid wood panels, and easily assembled at a separate location. Accordingly, in some embodiments, the individual modules may be shipped separately, and added to other modules after the fact. The particular configuration of framework 300 described herein is provided by way of example, and is not intended to be limiting. Other framework configurations are available within the scope of the present application.

FIG. 3E is a partial view of another portion of structural framework 300, FIG. 3A. The partial view depicted in FIG. 3E is similar to the partial view depicted in FIG. 3D, except that where FIG. 3D illustrates a "corner" joining of respective bar ends, FIG. 3E illustrates an exemplary "mid-bar" joining of one framework component to another. More particularly, in this example, side base bars 304 and side seat bars 310 are configured to include bar grooves 331, 332. In this configuration, vertical base bars 330 may then mate with side base bars 304 at side base grooves 331 and to side seat bars 310 at side seat grooves 332. Vertical base bars 330 may thus be included for aesthetic reasons, and/or to provide additional structural integrity for base module 102. Whether provided for structural or aesthetic purposes, this configuration of framework 300 enables one or more panels 333 to be provided between vertical rear base bars 302, vertical forward base bars 320, and additional vertical base bars 330. Panels 333 may then serve to partially or fully conceal internal components of base module 102 from external view, and/or may provide additional aesthetic advantages. In at least one embodiment, panels 333 may include some individual structural integrity, and include hand grips (not shown) within reach of a user. In an alternative embodiment, at least one panel 333 is not included in framework 300, thereby allowing a user to grip an underside of side seat bar 310 for a hand purchase.

FIG. 3F is a side view of base module 102 and the platform module 106 of modular exercise system 100, FIG. 1A. In the embodiment illustrated in FIG. 3F, base module 102 is configured to integrally mate with platform module 106 as a unitary structure. In an exemplary embodiment, base module 102 is integrated with platform module 106 by substituting side base bars 304 with opposing platform side bars 334. Similarly, lower rear base bar 306 may be substituted with an equivalent rear platform bar (not separately shown), and lower forward base bar 323 may be optionally excluded, with platform module 106 alternatively providing such support. Thus, in this embodiment, platform side bars 334 of platform module 106 joining with vertical bars 302, 320 at connection points 308, 335, respectively, in a manner as described above.

Also in a similar manner, vertical base bars 330 may alternatively join side platform bars 334 at respective side platform grooves 336. According to this configuration, Additionally, opposing platform side bars 334 may join together through implementation of a forward platform bar (not shown). It will be appreciated by one of ordinary skill in the art that the construction of the integrated framework structure of base module 102 and platform module 106 is provided by way of example, and not in a limiting manner. It will additionally be appreciated that, according to the embodiment illustrated in FIG. 3F, base module 102 and platform module 106 may be constructed as separate modules, a single integrated module, or as separate modules configured for alteration to integrate together in a unitary construction (i.e., removal of bar 304).

Additionally, base module 102 is shown to include first seat pad 116 coupled to base top 128. In at least one embodiment, first seat pad 116 may extend the entire depth-based top 128. In other embodiments, first seat pad 116 is configured to cover only a front portion of base top 128 and second seat pad 204 covers the remaining portion of base top 128. First and second seat pads 116, 128 as may be formed of a solid material suitable for supporting weight, such as, but not limited to, wood, plastic or metal, and may include other materials, such as, but not limited to, fabric and/or padding material.

FIG. 3G is a top view of base module 102, FIG. 1A. In an exemplary embodiment, base module 102 further includes a rear base plate 340 at base top 128 for coupling with back module 104. Rear base plate 340 may be configured to abut rear seat bar 312, and may be disposed between two opposing side seat bars 310 such that grooves 316 extend from rear seat bar 312 into rear base plate 340. In some embodiments, rear base plate 340 is coupled to side seat bars 310 by one or more base plate screws 342. In at least one embodiment, rear base plate 340 further includes a forward eyehole 344, a rear eyehole 345, and/or one or more knob slots 346, which are described below in greater detail.

FIG. 3H is a bottom view of back module 104, FIG. 1A. In an exemplary embodiment, second seat pad 204 includes a seat board 338 coupled to a seat plate 348. Coupling of seat board 3382 seat plate 348 may be accomplished, for example, using one or more seat plate screws 350. In the exemplary embodiment, seat plate 348 includes runners 352 configured to meet with grooves 316 in rear seat bar 312 and rear base plate 340. In one embodiment, runners 352 may be fabricated from, but not limited to, a rubber- or plastic-containing material. Accordingly, an extended seating area for base module 102 is provided when seat board 338 is coupled with rear base plate 340. This configuration may be particularly advantageous for larger individuals who wish to use the exercise system, but have been excluded by the traditional designs of conventional Pilates equipment.

FIG. 3I is a partial perspective view illustrating internal components of base module 102, FIG. 1A. In an exemplary embodiment, foot paddle unit 114 is coupled to platform top 140 within base module 102 in the forward direction. Alternatively, foot paddle unit 114 may be coupled to base bottom 130, within base module 102, and extend toward front end 110. In at least one embodiment, foot paddle unit 114 is coupled to opposing base sides 132 (e.g., structural framework bars thereof) proximate to base bottom 130 or platform top 140. Other configurations for coupling foot paddle unit 114 contemplated within the scope of the present application.

FIG. 3J is an exploded view of the foot paddle unit 114 of base module 102, FIG. 1A. In an exemplary embodiment, foot paddle unit 114 includes two forward extending bars 354 connected by crossbars 356, 358, with a forward crossbar 356 forward of a middle crossbar 358. Where foot paddle unit 114 is, for example, coupled to platform top 140 or to base bottom 130, forward extending bars 354 may each be further coupled with at least one tombstone screw 360, to respective opposing tombstone pieces 362 attached to platform module 106 or base module 102. In some embodiments, tombstone pieces 362 each contain at least one internal ball bearing (not shown) enabling the foot paddle to rotate about an axis. Conventional foot paddle units utilize piano hinges or pivot joints attached to wooden structural members, and are therefore bulky, and subject to wear over repeated use. According to the present embodiments though, the ball bearing joint within tombstone pieces 362 enables smoother movement in operation of foot paddle unit 114, which is a significant improvement. The structural configuration of tombstone pieces 362 to solid metal frame components further increases the longevity of the hinge. Moreover, the modular construction of system 100 allows for easy removal of foot paddle unit 114 and tombstone pieces 362 when desired, such as for replacement, disassembly, or to make room for other internal components. Foot paddle unit 114 may further include paddle extenders 364 and a foot pad 365, which may be disposed to cover a substantial portion of forward crossbar 356 and/or middle crossbar 358.

In the exemplary embodiment, foot paddle unit 114 further includes one or more foot paddle springs 366. Foot paddle springs 366 may vary diameter, coil wire thickness, and length, to achieve the desired elasticity and length of foot paddle springs 366 in operation of exercise system 100. Foot paddle spring 366 may further include a hook loop 368 for coupling to base module 102, and base module 102 may include at least two spring connection blocks 370 coupled to base module 102 through base connectors 372, which may be fixed using base connection screws 374. Spring connection blocks 370 may each be coupled to a respective connector eyebolt 376 extending from spring connection block 370 toward forward end 110. In one embodiment, the pair of connector eyebolts 376 are substantially the same length. In another embodiment, one of the pair of connector eyebolts 376 is closer to spring connection block 370 then the other.

In some embodiments, one or more foot paddle springs 366 may be couple at one end to hook loops 368. Hook loops 368 for the one or more foot paddle springs 366 may connect with connector eyebolts 376.

FIG. 3K is a perspective view illustrating an operational relationship of foot paddle unit 114 and base module 102, FIG. 1A. In some embodiments, one or more foot paddle springs 366 may be coupled at one end to foot paddle clips 380. In this example, foot paddle unit 114 includes at least one paddle eyebolt 382. In other embodiments, two paddle eyebolts 382 are connected to each forward extending bar 354, with paddle eyebolts 382 facing toward the base module 102 and rear end 112. Paddle eyebolts 382 may thus be configured to receive at least one foot paddle clip 380.

In a resting position, that is, when foot paddle springs 366 are in resting position (e.g., with some tension in the foot paddle springs 366), foot paddle unit 114 creates an obtuse angle relative to platform module 106 or base bottom 130. In operation, a user sits on first seat pad 116 with legs facing towards front end 110. The user places a foot or feet on forward crossbar 356 or foot paddle extenders 364 with knees bent, and may then apply force to foot paddle unit 114 by pressing down on foot paddle unit 114. As foot paddle springs 366 stretch, foot paddle unit 114 moves downward towards platform module 106. The number of foot paddle springs 366 attached to foot paddle unit 114 may increase the amount of force necessary to move foot paddle unit 114. Similarly, as noted above, foot paddle springs 366 may vary in diameter, coil wire thickness, and length to achieve desired elasticity. Thus, the advantageous modular construction of system 100 enables variance of the number of foot paddle springs 366, or the type of foot paddle spring 366, to increase or decrease the resistance applied to foot paddle unit 114 as desired.

FIG. 3L is a partial perspective view of base module 102, FIG. 1A. In an exemplary embodiment, base module 102 further includes a nested wheel assembly 387. Wheel assembly 387 includes one or more wheels 388 coupled to a pivot bar 390 (e.g., kidney-shaped, in this example). In the exemplary embodiment, bars 390 are secured to vertical rear base bars 302 by a wheel rotating pin 391, and wheels 388 may be coupled together by a wheel connection rod 392. Wheels 388 may be secured both to wheel connection rod 392 and pivot bar 390, for example, by a wheel screw 393.

In operation, pivot bars 390 are configured to pivot about wheel rotating pin 391, thereby allowing wheels 388 to be adjustably deployed in a number of positions with respect to base module 102. In one such position, wheels 388 may be housed within base module 102 and secured in position by wheel locking spring 394, to allow convenient storage of wheel assembly 387 when not in use (e.g., FIG. 3B). In a fully deployed position though, wheel assembly 387 is configured to pivot about wheel rotating pin 391 such that a portion of both wheels 388 touches an external surface (i.e. ground) behind rear end 112 of base module 102 or platform module 106. Pivot bars 390 thus allow wheels 388 to curve towards the external surface, and wheels 388 may be secured in this deployed position by wheel locking spring 394. When wheel assembly 387 is fully deployed and locked, base module 102 may be tipped backward towards rear end 112 such that the weight of exercise system 100 rests substantially on wheels 388. This position allows for convenient movement of exercise system 100.

FIG. 3M is a rear partial perspective view of base module 102, FIG. 1A. In an exemplary embodiment, base module 102 further includes a drawer assembly 395, for example, between vertical rear base bars 302 and below rear seat bar 312. Drawer assembly 395 may be configured to be easily removed when desired, as described further below with respect to FIG. 3N.

FIG. 3N is a front partial perspective view illustrating additional internal components of base module 102, FIG. 1A. In an exemplary embodiment, drawer assembly 395 is removed from base module 102, exposing two opposing drawer tracks 396, both of which may be directly attached to structural components of base module 102. Because the inclusion of drawer assembly 395 affects the amount of space available for foot paddle springs 366, in some embodiments, an optional L-shaped bar 397 is included within the interior of base module 102 to shield drawer assembly 395 from other internal moving components of base module 102 (e.g., springs). In the exemplary embodiment, L-shaped bar 397 attaches to base side 132 of base module 102 near rear end 112, and extends substantially perpendicular from base side 132 between two opposing base side 132 of base module 102, and then perpendicularly toward front end 110.

FIG. 3O is an additional front partial perspective view of the embodiment depicted in FIG. 3N. In the case where base module 102 includes L-shaped bar 397, one more clip bars 398 may be further included to extend substantially perpendicular to L-shaped bar 397 toward base sides 132. Additionally, foot paddle clips 380, which are attached to foot paddle springs 366, may then be advantageously attached to clip bars 398 when foot paddle springs 366 are not in use. This configuration advantageously prevents unwanted interference between foot paddle springs 366 and drawer assembly 395 when base module 102 includes drawer assembly 395.

Figure 4A:
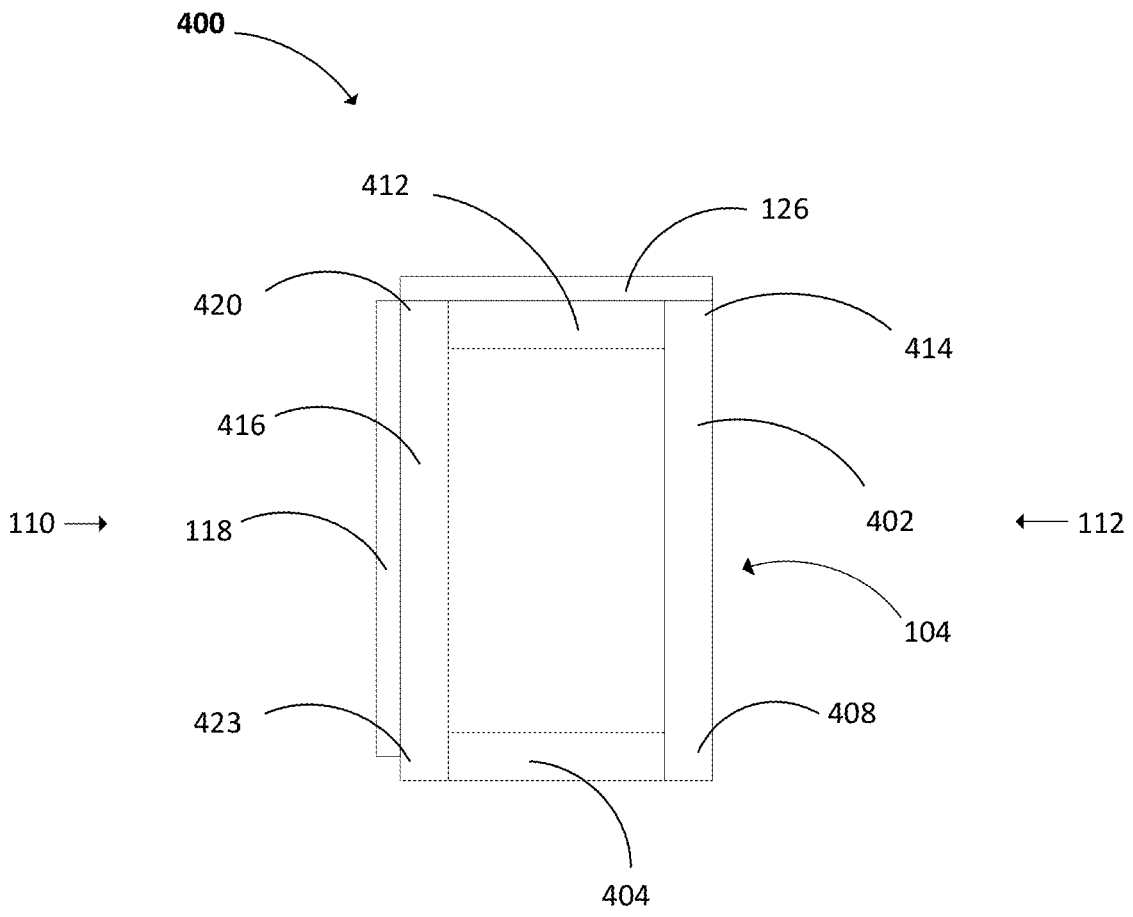
FIG. 4A is a side view of the back module depicted in FIG. 1A, illustrating an exemplary structural framework.

FIG. 4A is a side view of back module 104, FIG. 1A, illustrating an exemplary structural framework 400. Structural framework 400 of back module 104 is similar to structural framework 300 of base module 102, FIG. 3A, in general construction and the use of multiple connected frame bars. In an exemplary embodiment, back module 104 includes two vertical rear back bars 402, two lower side back bars 404, and a lower rear back bar 406 coupled together at rear back corner 408, in a manner similar to that described above with respect to connection point 308.

An exemplary embodiment, vertical rear back bars 402 extend vertically and, at back top 134, join with an upper rear back bar 410 and upper side back bars 412 at a rear upper corner 414. Upper side back bars 412 extend toward front end 110 of back module 104 and, at front end 110 of upper side back bars 412, join with two vertical forward back bars 416 and upper forward back bar 418 at forward upper corners 420. Also in the exemplary embodiment, vertical forward back bars 416 may extend toward lower side back bars 404 and join lower side back bars 404 and a lower forward back bar 422 at front lower corners 423. This particular configuration is provided by way of example, and is not intended to be limiting. Similar to the framework structures described above, framework 400 may also be formed of similar materials and constructed for similar ease of assembly, disassembly, and shipping.

Figure 4B:
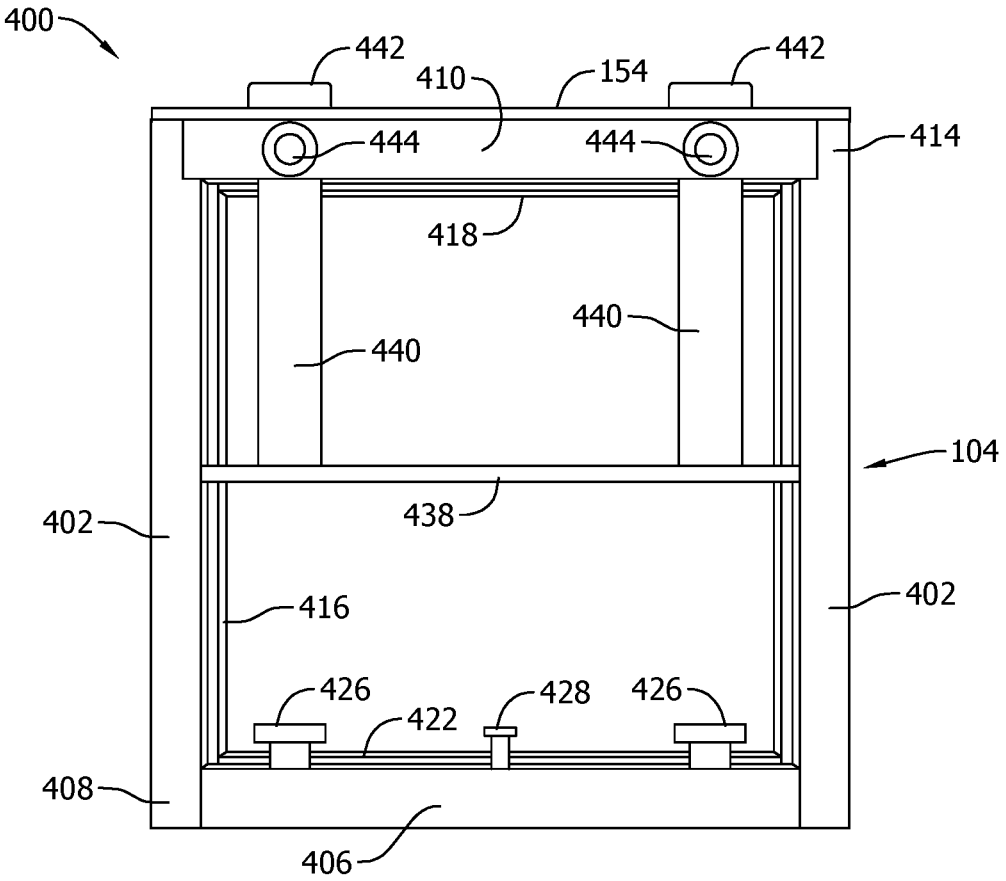
FIG. 4B is a partial rear perspective view of the back module depicted in FIG. 1A, according to an embodiment.

FIG. 4B is a partial rear perspective view of back module 104, FIG. 1A. In an exemplary embodiment, back module 104 includes a coupling plate 424 disposed between two lower side back bars 404, lower rear back bar 406, and lower forward back bar 422. Coupling plate 424 may include one or more coupling knobs 426. In the exemplary embodiment, coupling knobs 426 are disposed near lower rear back bar 406 and lower side back bars 404. In some embodiments, coupling plate 424 further includes a stability knob 428, disposed between lower side back bars 404 near lower forward back bar 422. Stability knob 428 may be disposed along a line connecting coupling knobs 426, or may be offset from coupling knobs 426 along a direction A.

Figure 4C:
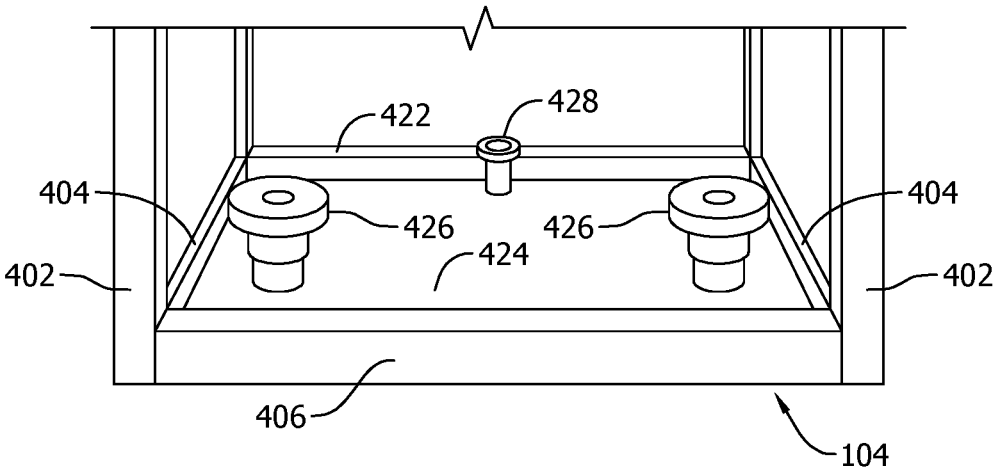
FIG. 4C is a rear view of the back module depicted in FIG. 1A, according to an embodiment.

FIG. 4C is a rear view of back module 104, FIG. 1A. In an exemplary embodiment, back module 104 further includes tower receiving tubes 440. Tower receiving tubes 440 may extend from a stability plate 438 to top back board 154. Tower receiving tubes 440 may be coupled with top back board 154, and also to an upper rear back bar 410. In some embodiments, tower receiving tubes 440 are positioned substantially proximate to stability plate 438 toward rear end 112, and each proximate vertical rear back bar 402. The outer shape of tower receiving tubes 440 is configured to correspond to the respective shape of tower feet 144 of tower module 108. As such, in some embodiments, a horizontal cross section of the tower receiving tubes 440 may be, but is not limed to, a substantially square or rectangular shape, which provides improved stability of tower module 108 in comparison with conventional tower assemblies that use rounded metal rods at the feet.

In an embodiment, tower mating unit 126 further includes top collars 442 about each of tower openings 146. Top collars 442 may, for example, be fabricated from, but not limited to, aluminum, an aluminum alloy, copper or other structurally sound materials. In the exemplary embodiment, top collars 442 each include a respective internal dimension extending through there vertical length for accommodating entry of tower feet 144. The external portions of the top collars 442 may be fabricated (e.g., for aesthetic or structural reasons) to form a variety of shapes, including, but not limited to, rectangular or circular; however, the internal dimensions of top collars 442 are configured to conform an outer cross-sectional shape of tower feet 144 and tower receiving tubes 440 to prevent play of tower module 108 with respect to back module 104 when external forces are exerted against the tower module 108. In some embodiments, back module 104 further includes tower knobs 444 disposed at upper rear back bar 410, and configured to extend into tower receiving tubes 440 two fixedly secure tower feet 144 when inserted into receiving tubes 440.

Figure 4D:
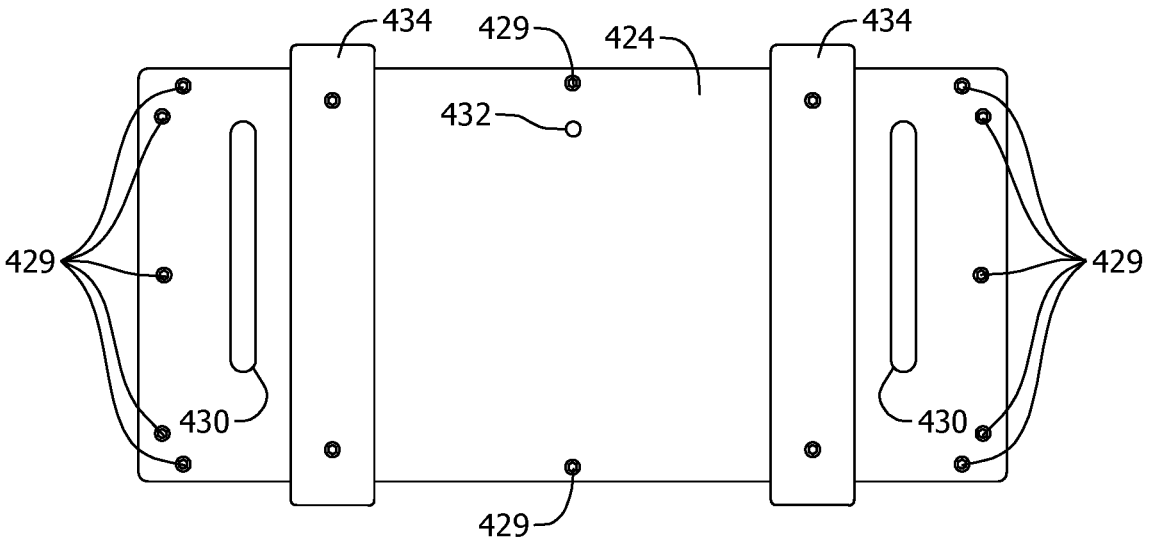
FIG. 4D is a bottom view of the back module depicted in FIG. 1A, according to an alternative embodiment.

FIG. 4D is a bottom view of an alternative configuration for back module 104, FIG. 1A. In an embodiment, coupling plate 424 includes at least one coupling plate screw 429 for joining coupling plate 424 with at least one of lower side back bars 404, lower rear back bar 406, and lower forward back bar 422. Coupling plate 424 may additionally include one or more slots 430, through which one end of a respective coupling knob 426 may travel. Coupling plate 424 a further include a stability knob eyehole 432, through which the end of the stability knob 428 may travel and securely fix thereto. Coupling plate 424 may further include coupling plate runners 434 configured to mate with grooves 316 in rear seat bar 312 and rear base plate 340 of base module 102. In some embodiments, coupling plate runners 434 may be fabricated from, but not limited to, a rubber- or plastic-containing materials.

In exemplary implementation, coupling plate 424 joins to rear seat bar 312 and rear base plate 340 of base module 102 by mating coupling plate runners 434 into the grooves 316. Back module 104 may then be secured to the base module 102 using either one or both coupling knobs 426 secured through the slots 430 and into knob slots 346, and/or stability knob 428 secured through stability knob eyehole 432, or by any combination thereof. In an exemplary embodiment, knobs 426, 428 are threaded and screwed into rear base plate 340. Coupling knobs 426 and stability knob 428 thereby enable back module 104 to be fixedly secured when adjusted horizontally relative to the base module 102. That is, knobs 426, 428 may be tightened to secure the back module 104 in place, but loosened when it is desired to adjust the position of back module 104.

Figure 4E:
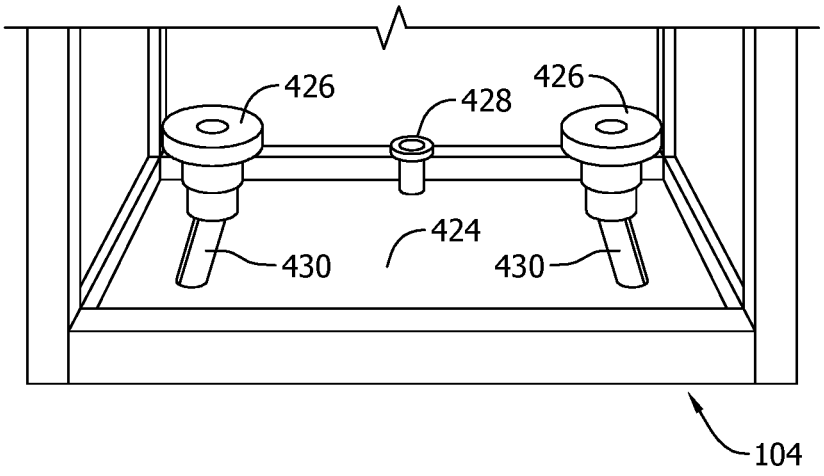
FIG. 4E is a partial rear perspective view of the back module depicted in FIG. 1A, according to an alternative embodiment.

FIG. 4E is a partial rear perspective view of an alternative configuration for back module 104, FIG. 1A. The embodiment illustrated in FIG. 4E is similar to the embodiment illustrated in FIG. 4B, but demonstrates a case where, as back module 104 is slidingly adjusted in direction A, coupling knobs 426 do not move from their original position. In this configuration, coupling knobs 426 are configured to travel through sliding slots 430, whereas stability knob 428 is configured to move with back module 104. To secure the back module 104 in this configuration, coupling knobs 426 are retightened into knob slots 346, while stability knob 428 is tightened into rear eyehole 345.

Figure 4F:
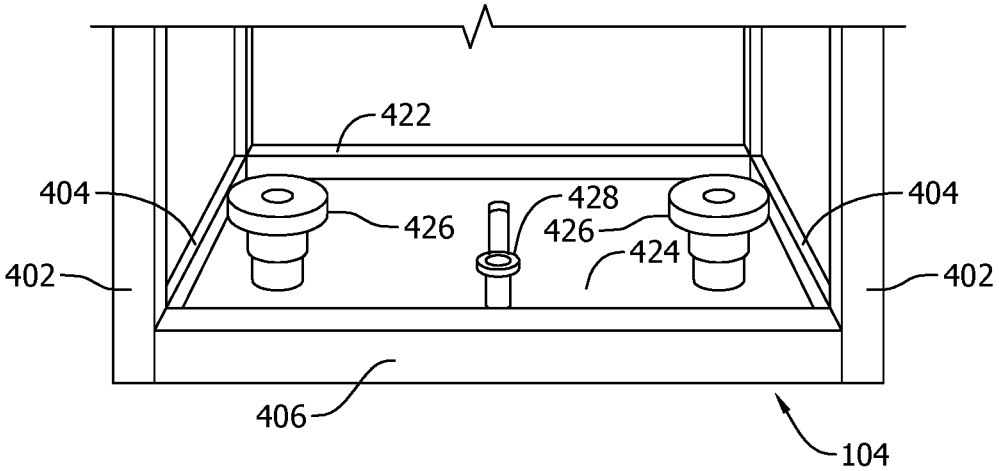
FIG. 4F is a partial rear perspective view of the back module depicted in FIG. 1A, according to an alternative embodiment.

FIG. 4F is a partial rear perspective view of an alternative configuration for back module 104, FIG. 1A. The embodiment illustrated in FIG. 4F is also similar to the embodiment illustrated in FIG. 4B, but demonstrates a case where coupling plate 424 includes stability knob 428 disposed substantially midway between lower side back bars 404 near lower rear back bar 406, substantially in line between coupling knobs 426, as described above.

Figure 4G:
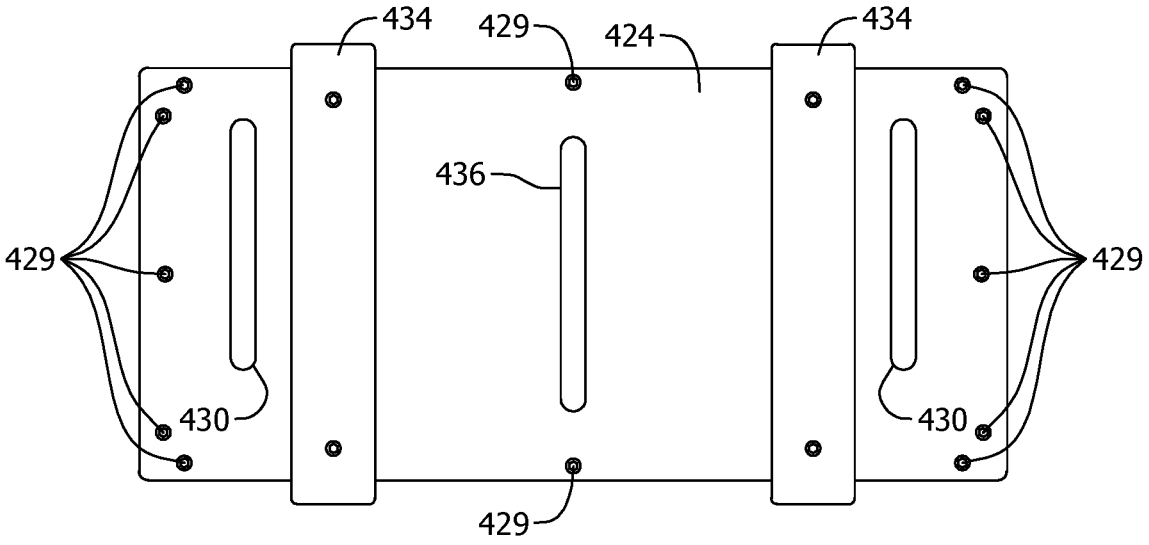
FIG. 4G is a bottom view of the back module depicted in FIG. 1A, according to an alternative embodiment.

FIG. 4G is a bottom view of an alternative configuration for back module 104, FIG. 1A. The embodiment illustrated in FIG. 4G is similar to the embodiment illustrated in FIG. 4D, but demonstrates a case where coupling plate 424 includes stability knob slot 436, through which a portion of stability knob 428 may travel. In in contrast to the embodiment described above with respect to FIG. 4D, stability knob slot 436 is configured to function as an alternative to stability knob eyehole 432.

Figure 4H:
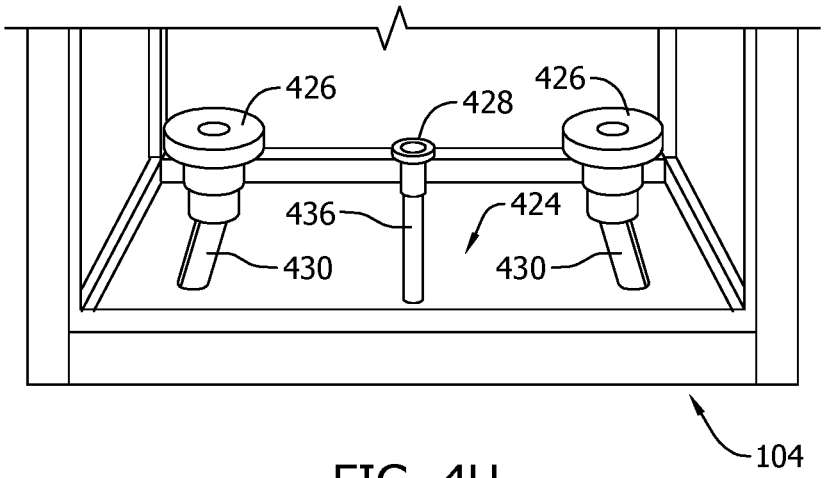
FIG. 4H is a partial rear perspective view of the back module depicted in FIG. 1A, according to an alternative embodiment.

FIG. 4H is a partial rear perspective view of an alternative configuration for back module 104, FIG. 1A. The embodiment illustrated in FIG. 4H is similar to the embodiment illustrated in FIG. 4F, but demonstrates a case where stability knob 428 maintained its position as back module 104 is slidingly adjusted. That is, stability knob 428 remains same position due to the inclusion of stability knob slot 436, and thus allows for a greater range of positions into which stability knob 428 can be secured, thereby providing additional versatility for adjustable seat depth ranges.

Figure 4I:
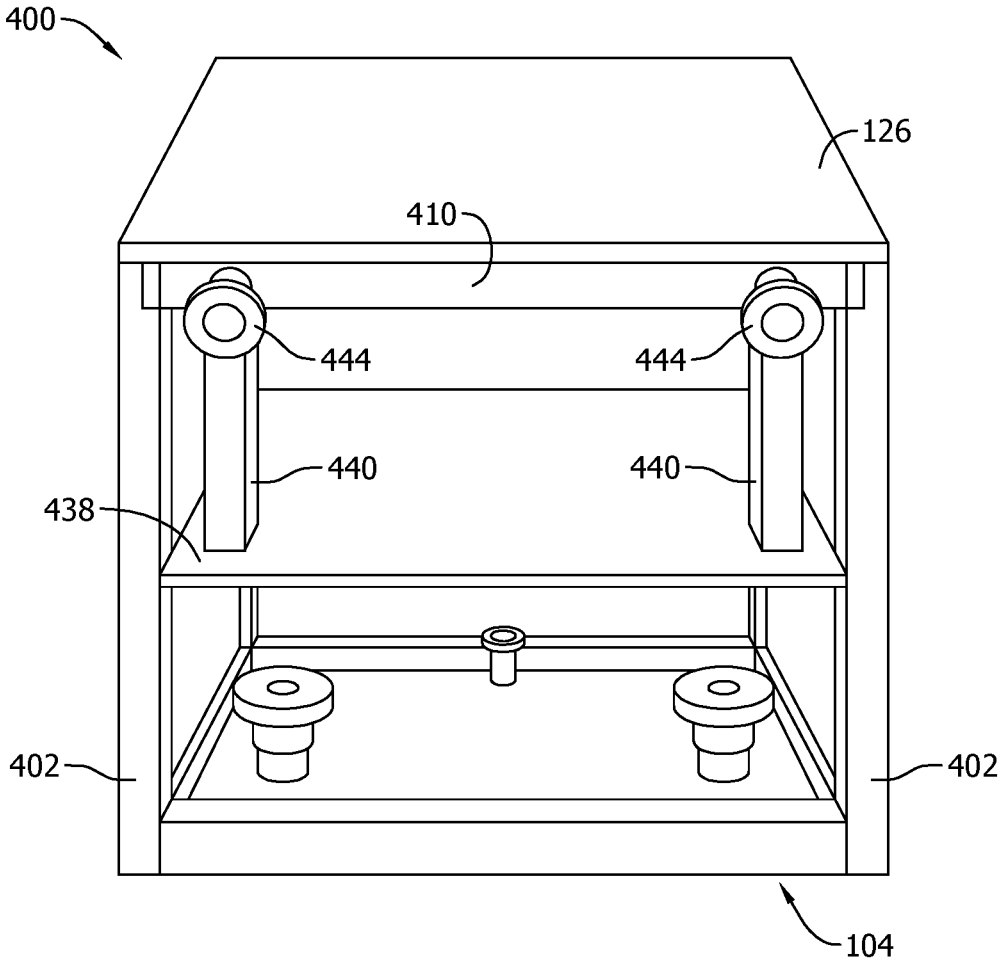
FIG. 4I is a partial rear perspective view of the back module depicted in FIG. 1A, according to an embodiment.

FIG. 4I is a partial rear perspective view of an alternative configuration for back module 104, FIG. 1A. In an exemplary embodiment, stability plate 438 of back module 104 joins with vertical rear back bars 402 and vertical forward back bars 416 substantially between lower rear back bar 406 and upper rear back bar 410. In sum embodiments, the stability plate 438 is disposed nearer to either lower rear back bar 406 or upper rear back bar 410. Stability plate 438 may thus be configured to cover all or part of the area between vertical rear back bars 402 and vertical forward back bars 416 such that, in some embodiments, stability plate 438 is configured to cover the entire area between all of the vertical bar bars 402, 416.

Figure 5:
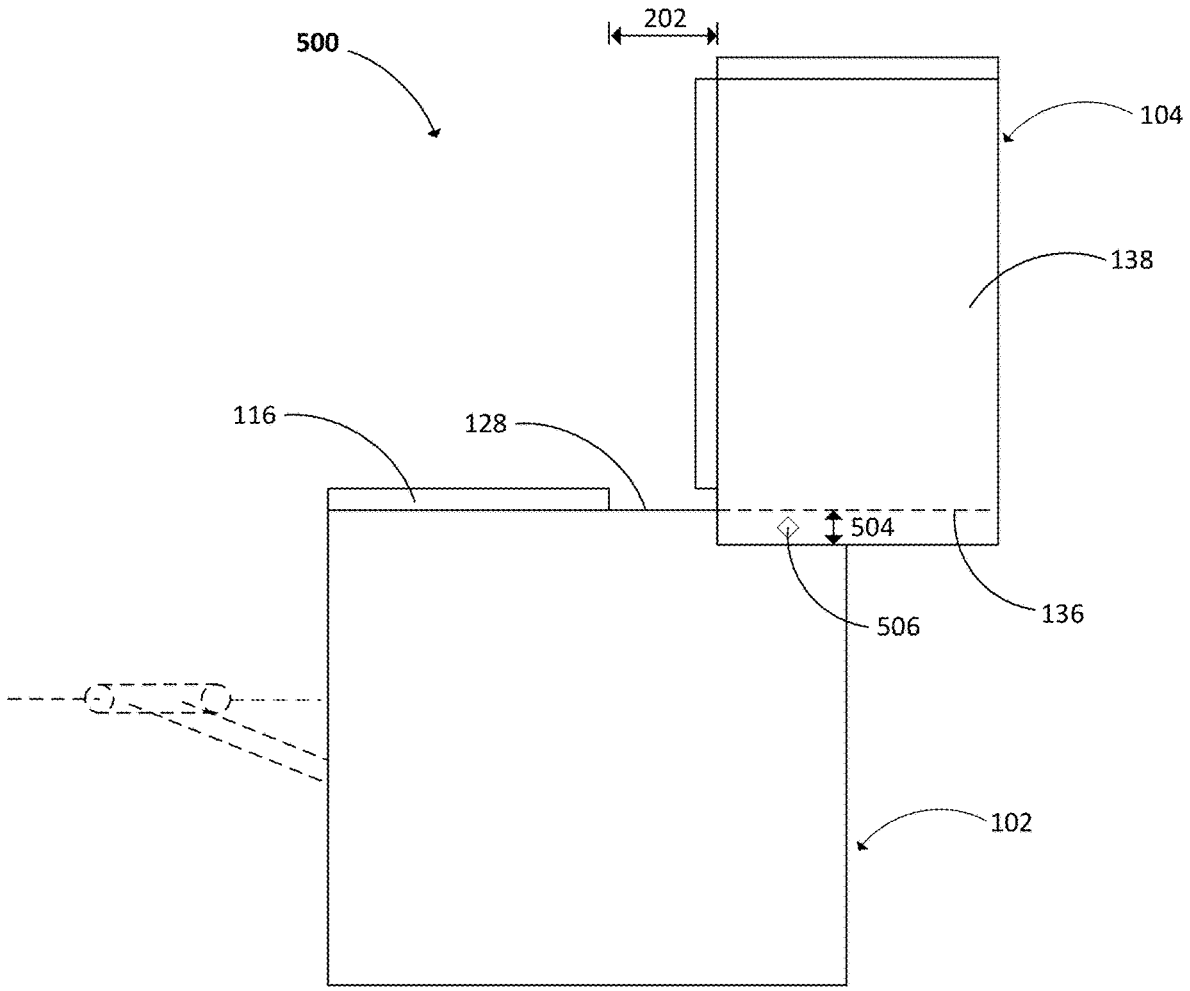
FIG. 5 is a side view of an adjustable high-back chair, according to an alternative embodiment.

FIG. 5 is a side view of an adjustable high-back chair 500. In this embodiment, back module 104 is fabricated such that two opposing back sides 138 (only one shown in FIG. 5) extend a distance 502 below back bottom 136, creating additional back side overhangs 504. In this configuration, back bottom 136 may be coupled to base top 128 with the internal surface of additional back side overhangs 504 substantially abutting the external surface of two opposing base sides 132. In this embodiment, a back affixer 506, such as, but not limited to, a screw or a pin, may be coupled through additional back side overhangs 504 and into base module 102. This configuration may be coupled combined with other features of base module 102 and back module 104 as described above. With this configuration, back module 104 may be shifted an additional seat depth 202 and then tightened into this position by back affixer 506. High-back chair 500 thus represents an alternative configuration to high-back chair 200, described above, in that back module 104 is slidingly adjustable in the same manner, but fixes at respective sides of base module 102, instead of slots in groups in the top portion.

Figure 6:
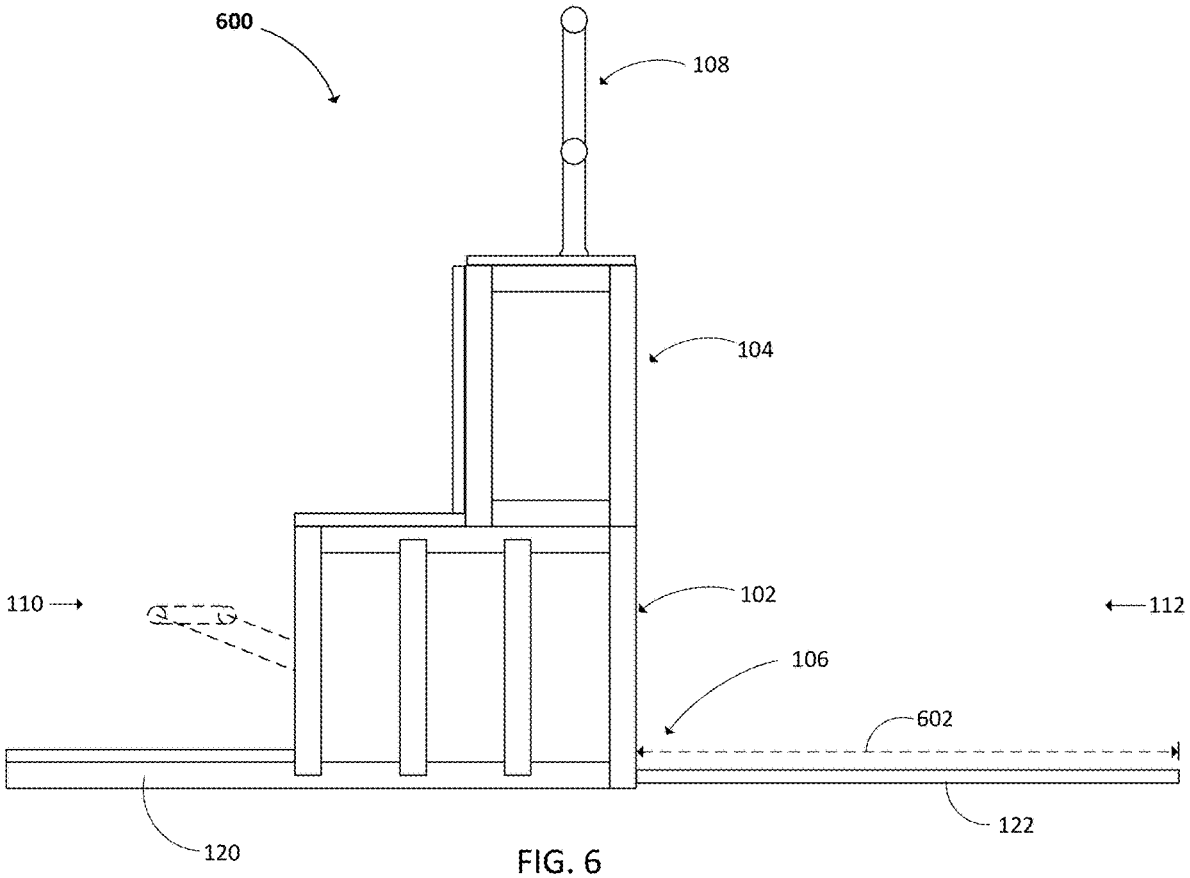
FIG. 6 is a side view of an adjustable tower apparatus, according to an embodiment.

FIG. 6 is a side view of an adjustable tower apparatus 600. In this embodiment, base module 102, back module 104, and platform module 106 may be separate modules coupled together, as described above, or one or more such modules may be one integrally constructed as a single assembly, or any combination thereof. For example, base module 102 and back module 104 maybe integrated as a single seat assembly (e.g., a non-adjustable high-back chair 200).

In an embodiment, rear stabilizer portion 122 may be nested within the platform module 106 or, as described above, rear stabilizer portion 122 may be pulled from rear end 112 of platform module 106 such that all or part of rear stabilizer portion 122 is removed from platform module 106 and moved a rear platform distance 602. Rear stabilizer portion 122 may provide additional space for using exercise system 100. In one embodiment, rear stabilizer portion 122 may be used in conjunction with tower module 108 for exercises performed behind the rear end 112 of exercise system 100, as described above.

Figure 7A:
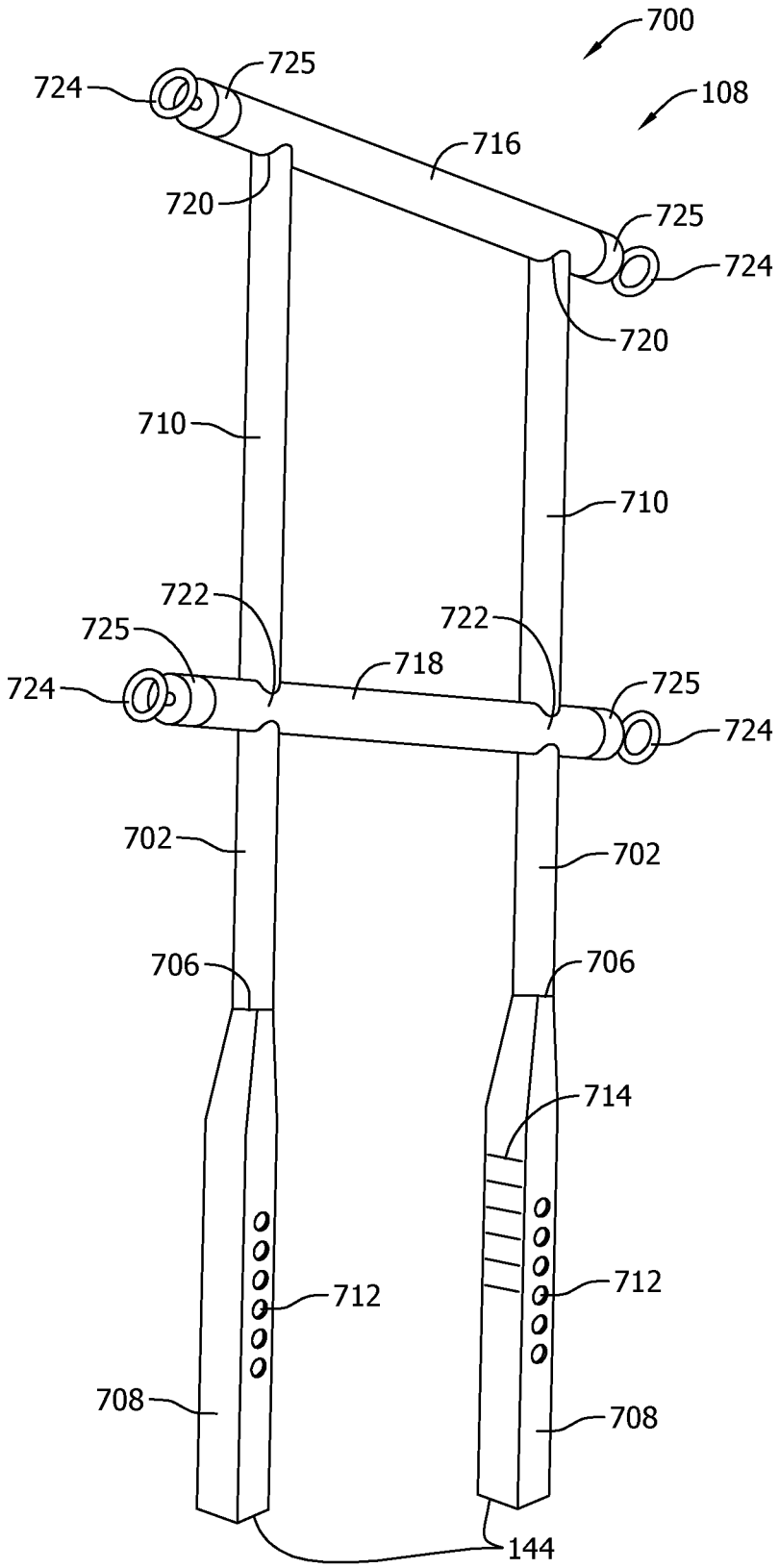
FIG. 7A is a perspective view of the tower module depicted in FIG. 1A, according to an embodiment.

FIG. 7A is a perspective view of tower module 108, FIG. 1A. In some embodiments, tower module 108 comprises two substantially parallel tower bars 702. Tower bars 702 may have a variety of configurations, however, in this example embodiment, at lower end 704 of tower bars 702, tower bars 702 are shaped such that a perpendicular cross section of the tower bar 702 forms substantially a square. This substantially square shape continues through the tower bars 702 until is tapers into a substantially circular shape at a tower junction 706. Between lower end 704 and tower junction 706, the "square section" 708, a perpendicular cross section forms substantially a square, except as square section 708 begins to taper at tower junction 706. After tower junction 706, a perpendicular cross sectional view of tower bars 702 is configured to form substantially a circle. This section is the "circular section" 710 of tower bars 702. In some embodiments, square sections 708 and circular section 710 may be made from one continuous piece of material such that tower bars 702 are each one continuous piece. In other embodiments, square sections 708 and circular sections 710 may be coupled together at tower junction 706. The above components of tower module 108 may be fabricated from, but not limited to, steel, aluminum or aluminum alloys.

Within the square section 708, one or more adjustment holes 512 may be added to tower bars 702. In order to assure the same height during operation, the adjustment holes must be placed in substantially the same place along the face facing rear end 112 of two tower bars 702. Within square section 708, tower bars 702 may additionally contain adjustment notches 714 etched into a side of square section 708. Adjustment notches 714 may be used to gauge the height of tower module 108 during operation. In some embodiments, adjustment notches 714 may be color coded to help determine the height of tower bars 702.

Two tower bars 702 may be joined by at least one crossbar 716, 718 that is substantially perpendicular to two tower bars 702. In an example embodiment, tower bars 702 are coupled together by two crossbars 716, 718, with one upper crossbar 716 coupled to tower top 142 at the end of circular sections 710 of two tower bars 702 at upper tower connection points 720 and another lower crossbar 718 coupled to circular sections 710 of two tower bars 702 at lower tower connection points 722, located between upper crossbar 716 and tower junction 706. In some embodiments, perpendicular cross sections of upper crossbar 716 and lower crossbar 718 are substantially circular. In some embodiments, length of crossbars 716, 718 is substantially the same between the two towers. One or both crossbars 716, 718 may extend outward from two tower bars 702 from tower connection points 720, 722 for a distance. In some embodiments, this outward distance may be substantially the same for both crossbars 716, 718 or one may extend further outward than the other.

Additionally, in some embodiments, crossbars 716, 518 may have tower eyehooks 724 coupled to one or both ends by tower eyehook couplers 725. In some further embodiments, one or more eyehooks and/or one or more tower eyehook coupling systems 725 may be configured to permanently lock in one position.

Figure 7B:
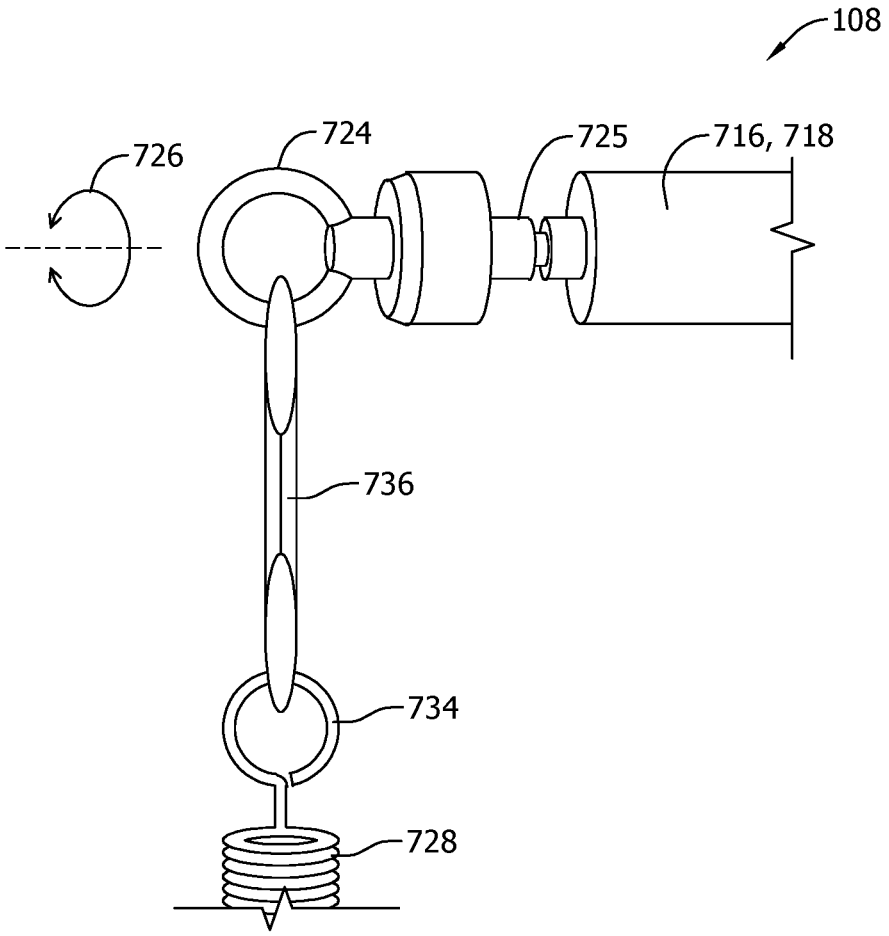
FIG. 7B is a partial perspective view of the coupling system of the tower module depicted in FIG. 7A, according to an embodiment.

FIG. 7B is a partial perspective view of coupling systems 725, FIG. 7A. In an exemplary embodiment, coupling systems and 25 includes one or more tower eyehooks 724 and/or one or more tower eyehook couplers 725 may be configured to swivel about an axis 726 parallel to crossbars 716, 718.

Figure 7C:
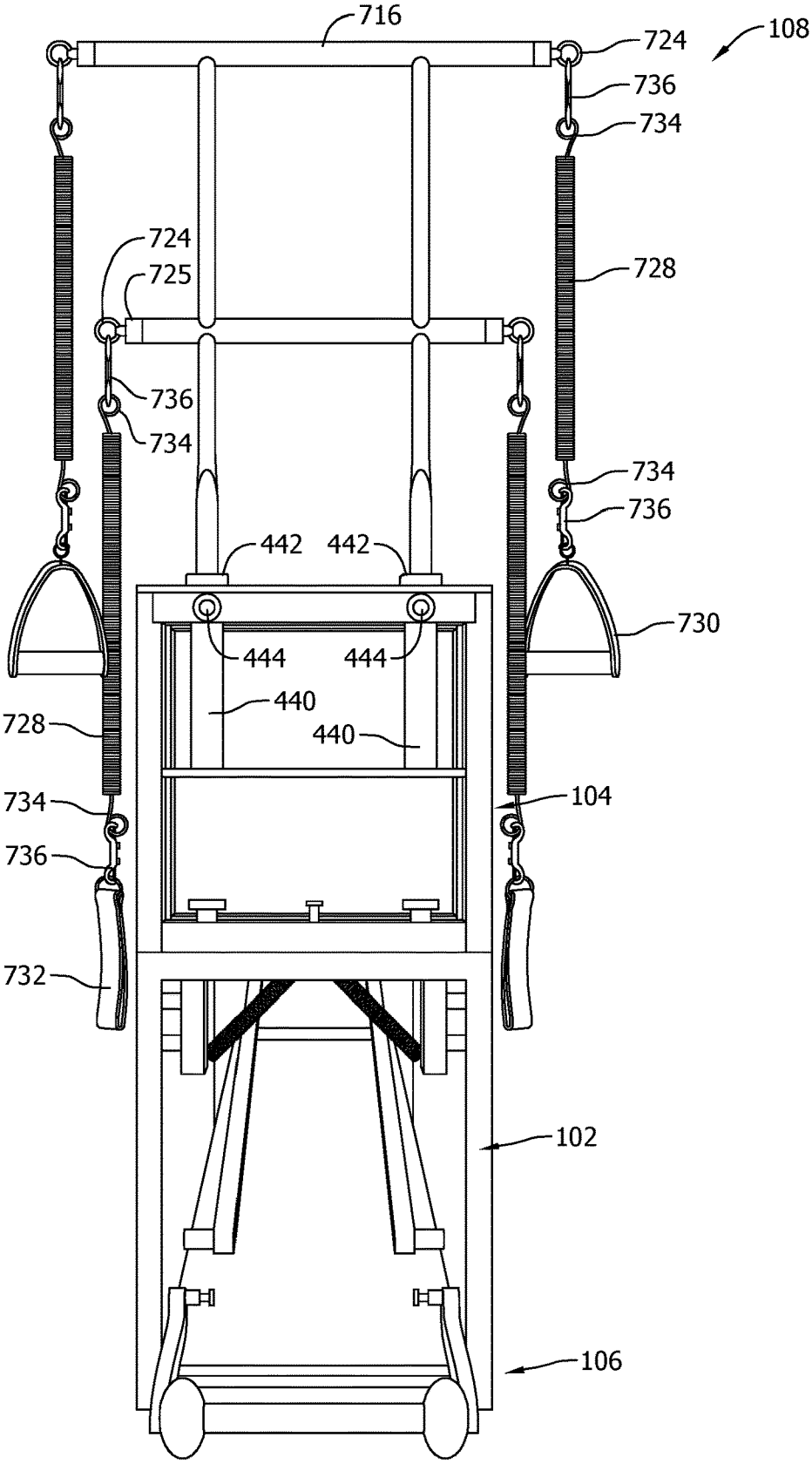
FIG. 7C is a rear perspective view of the modular exercise system depicted in FIG. 1A, according to an embodiment.

FIG. 7C is a rear perspective view of modular exercise system 100, FIG. 1A, incorporating tower module 108. In an exemplary embodiment, tower module 108 may be coupled to back module 104 and back module 104 may be coupled to base module 102 and platform module 106. In the example embodiment, lower end 704 (not shown in FIG. 7C) of tower module 108 is lowered through top collars 442 of back module 104 into tower receiving tubes 440, with adjustment holes 712 (not shown in FIG. 7C) facing towards rear end 112 of the back module 104. In operation, tower knobs 444 may be used to adjust the height of tower module 108 once it passes into tower receiving tubes 440. Tower knobs 444 contain a pin (not shown) that passes through upper rear back bar 410 into tower receiving tubes 440. The pin may be coupled to adjustment holes 512 of tower module 108, securing tower module 108 at a specified height. Accordingly, various types of tower springs 728 and spring grips 730, 732 may be attached to tower module 108 at tower eyehooks 724.

Figure 7D:
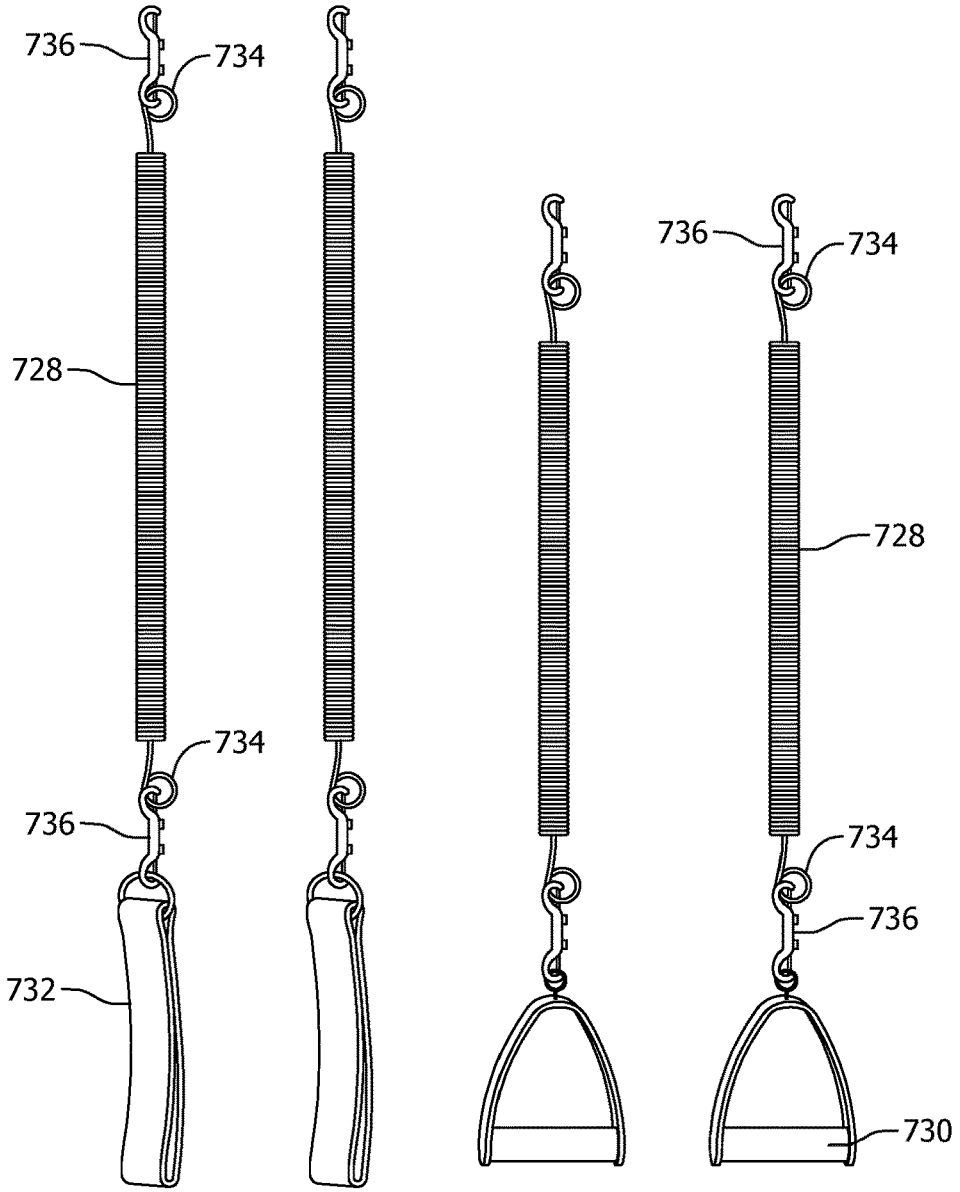
FIG. 7D is a perspective view of the tower springs and tower grips of the tower module of the modular exercise system depicted in FIG. 7C.

FIG. 7D is a perspective view of tower springs 728 and tower grips 730, FIG. 7C. FIG. 7D illustrates an example embodiment of tower springs 728 and spring grips 730, 732. Tower springs 728 may vary in diameter, coil wire thickness, and length to achieve the necessary elasticity and length of tower springs 728 in operation of exercise system 100. Tower springs 728 may be coupled to tower spring eyehooks 534 at one or both ends. Each tower spring eyehooks 734 may be coupled to one or more tower clips 736. At least one spring grip 730, 732 may be coupled to one or more tower clips 736. As shown in FIG. 7C, spring grips 730, 732 may consist of a handle spring grip 730, a strap spring grip 732 or other suitable grips for gripping the tower springs 728 for exercise. In one example embodiment, a spring grip 730, 732 may be attached to one tower clip 736 coupled to tower spring eyehook 734 at one end of a tower spring 728. At the opposing end of tower spring 728 with tower spring eyehook 734, tower clip 736 may be coupled to tower eyehook 724. In one example embodiment, as shown in FIG. 7C, when in operation, four tower springs 728 with spring grips 730, 732 may be coupled to tower module 108 at each of the four tower eyehooks 724. It will be appreciated that more or less tower springs 728 can be attached to tower module 108 depending on the desired operation of exercise system 100.

In one embodiment, as described above, square sections 708 of tower bars 702 contain a substantially square perpendicular cross-section and tower receiving tubes 440 also contain a substantially square perpendicular cross-section. When square sections 708 of tower bars 702 are coupled within the tower receiving tubes 440, the coupling creates a substantially tight fit between the internal faces of tower receiving tubes 440 and the external faces of square sections 708 of tower bars 702. This square configuration both tower bars 702 and tower receiving tubes 440 helps prevent shacking of tower module 108 when force is applied to the tower by the movement of tower springs 728 during use because there are up to four points of contact for tower bars 702 to tower receiving tubes 440. Other towers on the market currently have circular configurations, which, when placed into circular tubes, can create a less stable coupling of these towers to the circular tubes. As such, when in use, these circular towers can shake within the circular tubes, leading to a less smooth motion when the circular tower is in use.

As discussed above, in some embodiments, tower eyehole 724, tower eyehook coupler 725, or both, may swivel. This swivel feature allows tower eyehook 724 to follow the angle of an attached tower spring 728. This feature provides a smooth angle between tower eyehook 724 and attached tower spring 728 and helps prevent a jerking motion when tower spring 728 is in use, providing a smoother motion during operation of exercise system 100.

Figure 7E:
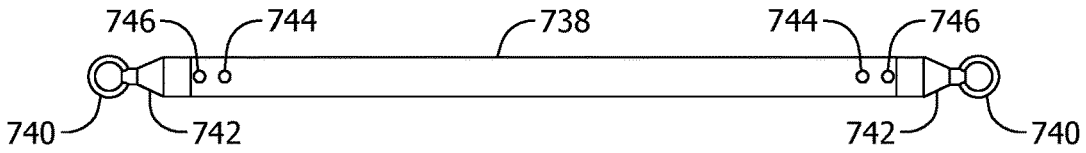
FIG. 7E is a perspective view of a roll bar that may be implemented with the tower module of the modular exercise system depicted in FIG. 7C.

FIG. 7E is a perspective view of a roll bar that may be implemented with the tower module of the modular exercise system depicted in FIG. 7C. In some embodiments, two tower springs 728 attached to the same crossbar 216 or 218 may be coupled to a roll-down bar 738 (not shown). FIG. 7E provides an example embodiment for roll-down bar 738. In this example embodiment, a perpendicular cross-section of the roll-down bar 738 may be substantially circular, however, roll-down bar 738 may be any shape that will allow roll-down bar 738 to function as described here. Further, in roll-down bar 738 may be fabricated from, but not limited to, stainless steel. It may be any length to perform the functions describes herein, however, in the exemplary embodiment, roll-down bar 738 is substantially the same length of the crossbar 216 or 218 it is coupled to. Additionally, roll-down bar 738 may couple to other pieces of equipment within exercise system 100 or other exercise equipment, such as a trapeze table.

In some embodiments, roll-down bar eyehooks 740 may be coupled to the opposing ends of roll-down bar 738 at eyehook interface points 742. Eyehooks 740 may be substantially stationary or may swivel about an axis, as described above for tower eyehooks 724. Additionally, as shown in the exemplary embodiment in FIG. 7E, roll-down bar eyehooks 740 may be configured to both lock into a particular configuration or swivel about an axis at eyehook interface points 742. In this embodiment, eyehooks 740 may be coupled to roll-down bar 738 by inward bolts 744. Each eyehook 740 has an internal member (not shown) that extends into roll-down bar 738. Inward bolts 744 extend through roll-down bar 738 and into or through the internal members of roll-down bar eyehooks 740. In this embodiment, an additional outward bolt 746 is placed between inward bolt 744 and eyehook interface points 742 at each of the opposing ends of roll-down bar 738. Outward bolts 746 extend through roll-down bar 738 and couple to roll-down bar eyehooks 740 such that when outward bolts 746 are tightened, the roll-down bar eyehooks 740 are in a locked configuration and when outward bolts 746 are loosened, the roll-down bar eyehooks 740 swivel about an axis at eyehook interface points 742. The bolts 744, 746 may be, but are not limited to, Allen bolts.

The ability for roll-down bar eyehooks 740 of roll-down bar 738 to both swivel about an axis, and/or remain in a locked configuration, adds additional versatility to roll-down bar 738. For some exercises, the swivel ability of the may provide for a smoother motion is connected to springs or other similar exercise equipment. In other exercises, it may be advantageous to have the roll-down bar eyehooks 740 in a locked position.

Figure 8:
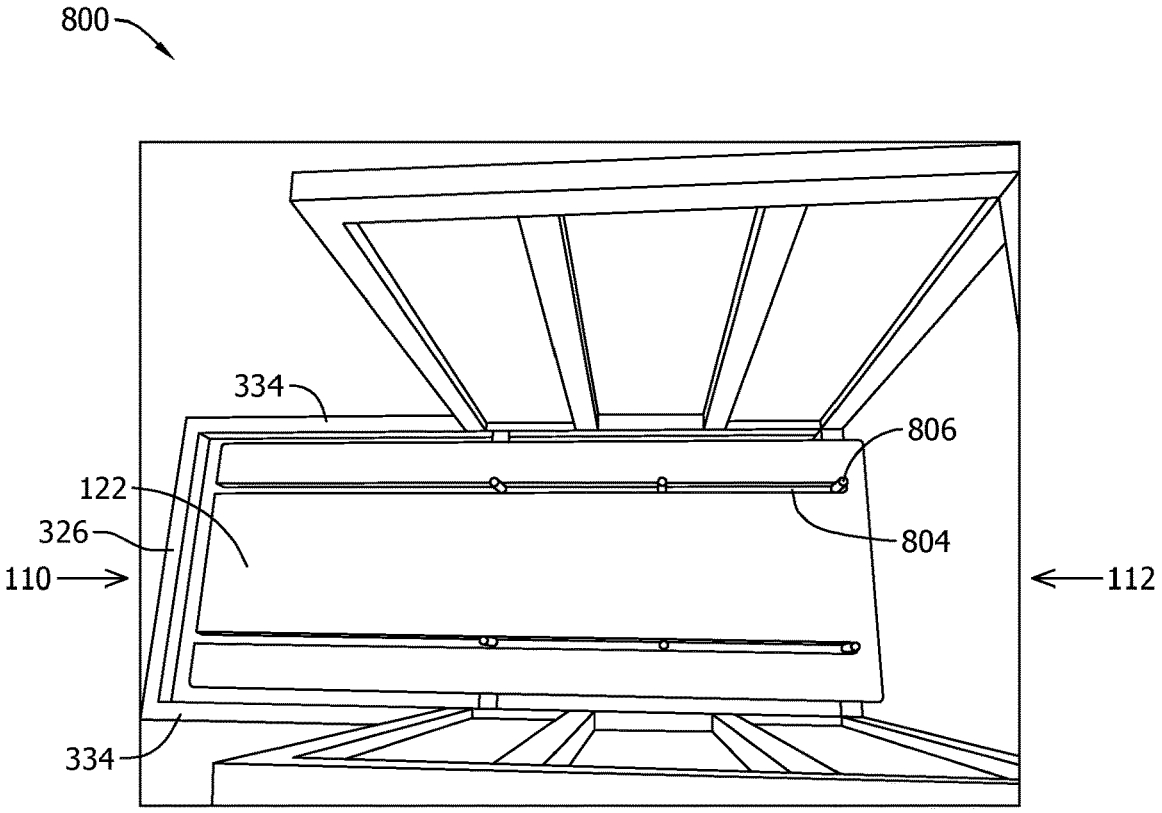
FIG. 8 is an internal top perspective view of the platform module depicted in FIG. 1A, according to an embodiment.

FIG. 8 is an internal top perspective view of platform module 106, FIG. 1A. In an exemplary embodiment, rear stabilizer portion 122 may be fabricated from one sheet of material, such as, but not limited to, aluminum or an aluminum alloy. Rear stabilizer portion 122 may contain one or more platform slots 804, which, in some embodiments, may extend from the forward end 110 of rear stabilizer portion 122 towards the rear end 112. In some embodiments, platform slot 804 vertically through extend through the rear stabilizer portion 122 creating a complete opening for platform slot 804. One or more platform fastening screws 806 may be attached to platform module 106. The one or more platform fastening screws 806 may extend vertically towards base module 102 from platform module 106 and the one or more platform fastening screws 806 may be configured such that the one or more platform fastening screws 806 are within platform slot 804 when rear stabilizer portion 122 is housed within platform module 106. In a further embodiment, platform board 156 may be coupled to platform module 106 above rear stabilizer portion 122 and one or more platform fastening screws 806 may extend through the platform board 156 (not shown). A platform knob or knobs may be coupled to the platform fastening screws 806 above the platform board 156 (not shown). In operation, platform knob or knobs may be tightened to secure rear stabilizer portion 122 in place or may be loosened to allow movement of the rear platform about a forward-rear axis.

Figure 9:
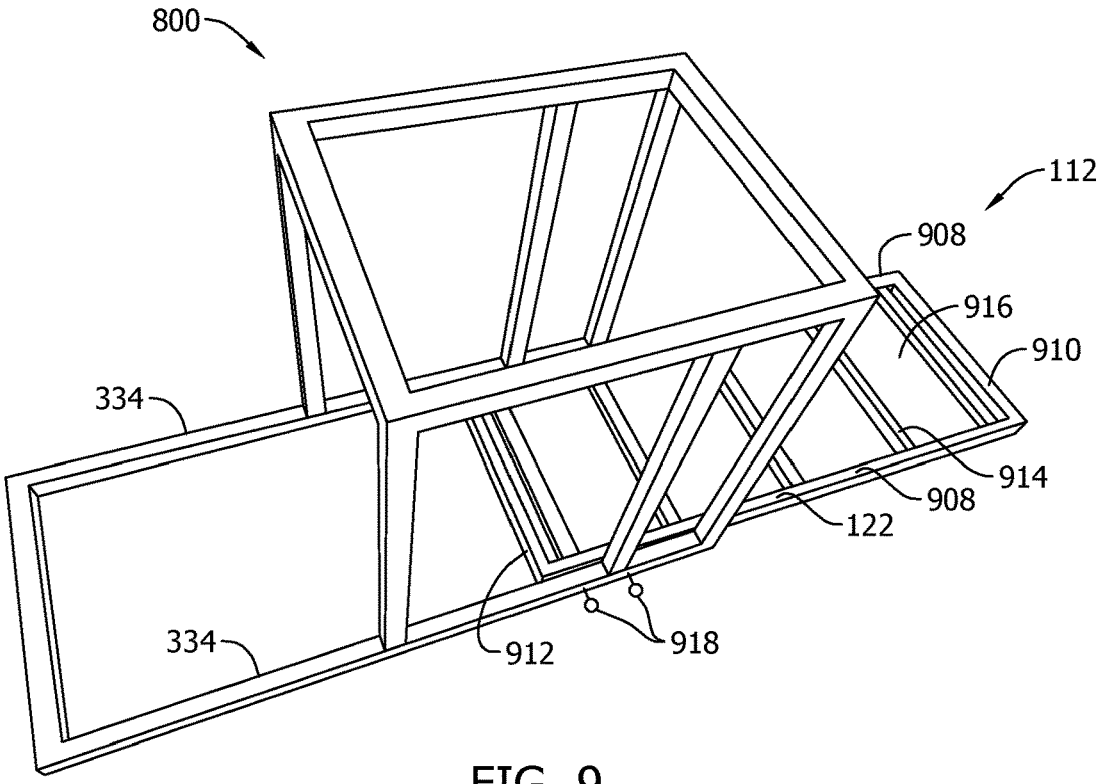
FIG. 9 is a perspective view illustrating an operational relationship of the base module and the platform module depicted in FIG. 1A, according to an embodiment.

FIG. 9 is a perspective view illustrating an operational relationship of base module 102 and platform module 106, FIG. 1A. In this embodiment, rear stabilizer portion 122 has a more modular construction than the embodiment described with reference to FIG. 8, such that rear stabilizer portion 122 may be comprised of two rear platform side bars 908, a rear platform rear bar 910, and a rear platform forward bar 912, wherein rear platform side bars 908 are each coupled to rear platform rear bar 910 and rear platform forward bar 912. All rear platform bars 908, 910, 912 are configured to fit between opposing platform side bars 334 when rear platform bars 908, 910, 912 are assembled. In this embodiment, rear stabilizer portion 122 may contain one or more rear platform crossbars 914 placed substantially perpendicular to rear platform side bars 908 and configured to couple to each opposing rear platform side bar 908. One or more rear platform gaps 916 may be formed between rear platform rear bar 910, rear platform forward bar 912, and/or rear platform crossbars 914. Within these gaps, rear platform boards (not shown) may be placed. The rear platform boards may consist of a solid material suitable for supporting weight, such as, but not limited to, wood, plastic or metal. Additionally, in some further embodiments, the rear platform boards may be coupled to other materials, such as, but not limited to, fabric and/or padding material. Additionally in this embodiment, screws may be coupled through platform side bars 334 such that they may be tightened to secure rear stabilizer portion 122 in place or loosened to adjust the position of rear stabilizer portion 122.

When coupled to seat system 108 with tower module 108 attached, rear stabilizer portion 122 may function to stabilize the seat system 108 when the tower module 108 is engaged during exercise off behind rear end 112. Either embodiment described with reference to FIGS. 8 and 9, or other similar embodiments, may be used to stabilize exercise system 100 with tower module 108 attached. The embodiment described with reference to FIG. 9 provides some additional advantages. Because of its modular construction, the pieces may be broken apart for shipment or storage and later assembled. Further, the modular construction allows rear stabilizer portion 122 to be more lightweight than a solid platform, such as the one described with reference to FIG. 8. This lighter weight makes it easier for a user of exercise system 100 to remove rear stabilizer portion 122 from platform module 106, when finished with the intended use, return rear stabilizer portion 122 into platform 106 module for storage, thus saving space in the area behind rear end 112 and allowing for transport of rear stabilizer portion 122 with the rest of exercise system 100 when wheels 388 are used.

Figure 10:
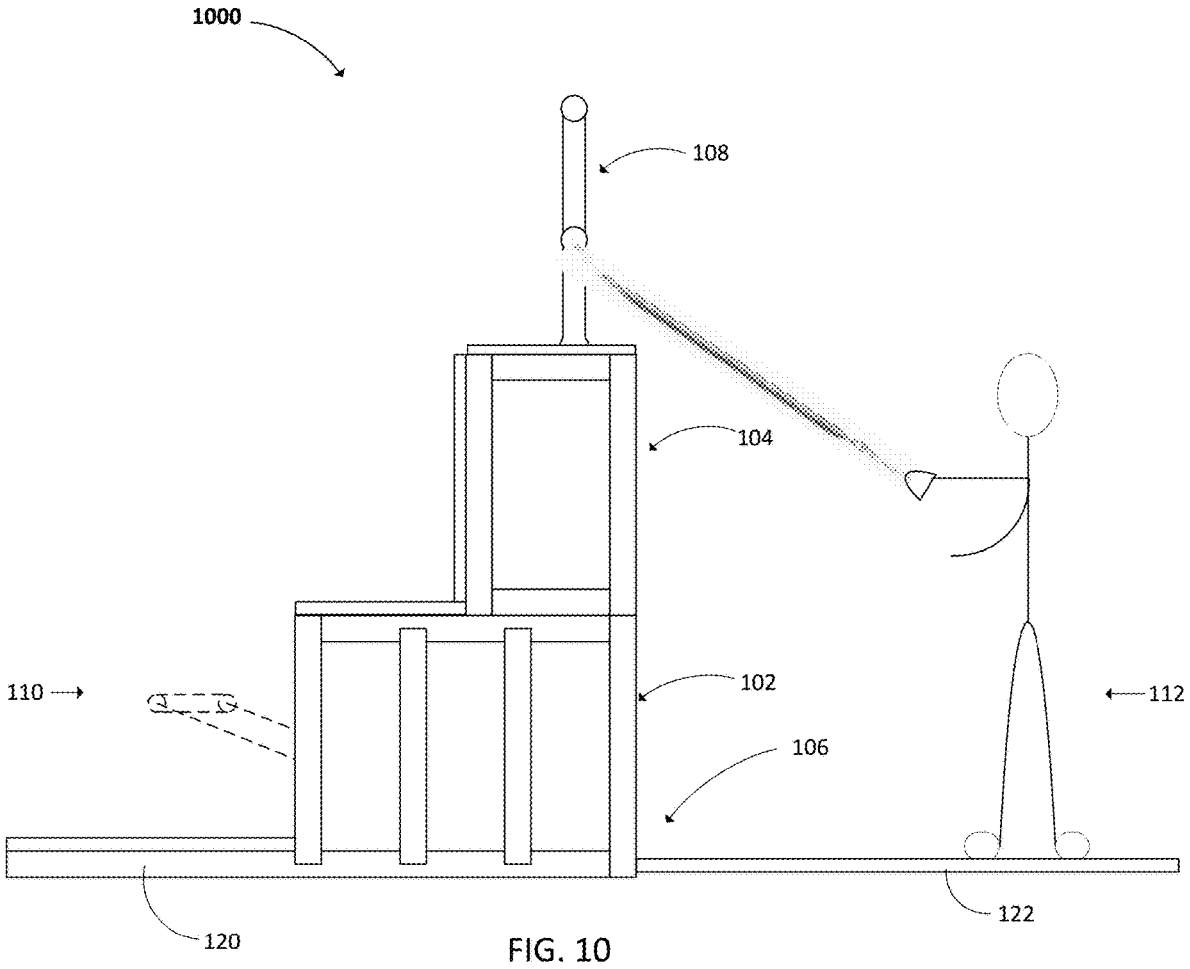
FIG. 10 is a side view illustrating an operational principle of the tower module integrated with the modular exercise system depicted in FIG. 1A, according to an embodiment.

FIG. 10 is a side view illustrating an operational principle 1000 of tower module 108 integrated with modular exercise system 100, FIG. 1A. In one example of operation of exercise system 100 with tower module 108 coupled to back module 104, as illustrated by FIG. 10, a person may stand in the space behind rear end 112 and grip in one hand one spring grip 730, 732 attached to a tower spring 728 coupled to tower module 108. The person may then, for example, step a distance away from exercise system 100 until the spring is taut with a substantially straight line created between their arm stretched straight in front of him and the line of tower spring 728. From this position, the person may pull grip 730, 732 backwards, to a position where their upper arm and elbow is substantially parallel to their torso. This sample exercise may provide exercise for one of the trapezius muscles, the latissimus dorsi, or other muscles. It will be appreciated that this configuration of the tower module 108 provides a variety of possible exercises and is not limited to the one example embodiment.

We claim:

1. An exercise system, comprising:

a base module including a seat portion having a seat depth in a lengthwise direction from a front portion of the base module toward a rear portion of the base module;

an adjustable back module configured to fixedly engage with the base module at a first seat depth and a second seat depth different from the first seat depth in the lengthwise direction; and a foot paddle unit disposed proximate the front portion of the base module opposite the rear portion of the base module, the foot paddle unit including (i) a paddle crossbar disposed forward of the front portion and along a widthwise direction perpendicular to the lengthwise direction, (ii) a paddle pivot joint fixedly attached with respect to the base module proximate a base bottom portion of the base module forward of the rear portion, and (iii) a forward paddle extending bar operably coupling the paddle crossbar to the paddle pivot joint, wherein the seat portion is disposed opposite the base bottom portion, and includes two opposing base sides distributed substantially parallel one another across the foot paddle unit and structurally coupling the seat portion to the base bottom portion, wherein the two opposing base sides each includes (i) a first horizontal base support member disposed proximate the seat portion, (ii) a second horizontal base support member disposed proximate the base bottom portion, and (iii) a plurality of vertical base support members fixedly coupling the first horizontal base support member to the second horizontal base support member, and wherein the paddle pivot joint includes two opposing base joints fixedly attached to respective internal surfaces of opposing ones of the plurality of vertical base support members of the two opposing base sides.

2. The exercise system of claim 1, further comprising a detachable platform module configured for fixedly engaging with the respective second horizontal base support members of the two opposing base sides beneath the base module in the heightwise direction.

3. The exercise system of claim 2, wherein the paddle pivot joint comprises two opposing base joints fixedly attachable to the detachable platform module with the forward paddle extending bar disposed therebetween.

4. The exercise system of claim 2, wherein the detachable platform module extends forward from the rear portion of the base module to a front platform end located forward of the forward paddle extending bar.

5. The exercise system of claim 1, wherein the foot paddle unit further comprises a foot paddle spring having (i) a first spring end attached to at least one of the paddle crossbar and the forward paddle extending bar forward of the front portion, and (ii) a second spring end attached to a fixed spring connector disposed within the base module above the paddle pivot joint in a heightwise direction when seen relative to the base bottom portion and perpendicular to the lengthwise and widthwise directions.

6. The exercise system of claim 1, wherein each of the two opposing base sides further comprises a base hand grip disposed between two adjacent vertical base support members of the plurality of vertical base support members.

7. The exercise system of claim 1, wherein the seat portion further comprises (i) a back module engagement mechanism for fixedly engaging the adjustable back module to the base module at each of the first and second seat depths, and (ii) a forward seat pad fixedly attached to the base module above the back module engagement mechanism in the heightwise direction.

8. An exercise system, comprising:

a base module including a seat portion having a seat depth in a lengthwise direction from a front portion of the base module toward a rear portion of the base module;

an adjustable back module configured to fixedly engage with the base module at a first seat depth and a second seat depth different from the first seat depth in the lengthwise direction; and a foot paddle unit disposed proximate the front portion of the base module opposite the rear portion of the base module, the foot paddle unit including (i) a paddle crossbar disposed forward of the front portion and along a widthwise direction perpendicular to the lengthwise direction, (ii) a paddle pivot joint fixedly attached with respect to the base module proximate a base bottom portion of the base module forward of the rear portion, and (iii) a forward paddle extending bar operably coupling the paddle crossbar to the paddle pivot joint, wherein the seat portion is disposed opposite the base bottom portion, and includes two opposing base sides distributed substantially parallel one another across the foot paddle unit and structurally coupling the seat portion to the base bottom portion, wherein the two opposing base sides each includes (i) a first horizontal base support member disposed proximate the seat portion, (ii) a second horizontal base support member disposed proximate the base bottom portion, and (iii) a plurality of vertical base support members fixedly coupling the first horizontal base support member to the second horizontal base support member, wherein the seat portion includes (i) a back module engagement mechanism for fixedly engaging the adjustable back module to the base module at each of the first and second seat depths, and (ii) a forward seat pad fixedly attached to the base module above the back module engagement mechanism in the heightwise direction, wherein the back module engagement mechanism includes a seat plate fixedly attached to each of the first horizontal base support members of the two opposing base sides, wherein the adjustable back module includes a fixed coupling plate disposed at a bottommost surface of the adjustable back module, and wherein the seat plate includes at least one seat mating groove configured to slidingly engage with a complementary module coupling runner extending from the fixed coupling plate facing the seat plate.

9. The exercise system of claim 8, further comprising a tower module configured to vertically and detachably engage with the adjustable back module, the tower module including two substantially parallel vertical tower bars fixedly connecting two substantially parallel horizontal crossbars.

10. The exercise system of claim 9, wherein the adjustable back module further comprises (i) an internal tower receiving structure for detachably receiving respective lower portions of the two substantially parallel vertical tower bars, and (ii) an adjustable tower locking mechanism for detachably fixing the respective lower portions of the two substantially parallel vertical tower bars to the internal tower receiving structure.

11. The exercise system of claim 9, wherein each of the two substantially parallel horizontal crossbars comprise opposing crossbar end portions disposed outwardly from the substantially parallel vertical tower bars in the widthwise direction, and wherein each respective crossbar end portion includes a swivel coupler configured for (i) rotational movement within a plane perpendicular to a cylindrical revolution axis of the respective horizontal crossbar, and (ii) fixed coupling to the respective horizontal crossbar both along the cylindrical revolution axis and in a radial direction perpendicular to the cylindrical revolution axis.

12. The exercise system of claim 8, further comprising an adjustable coupling knob for detachably fixing the adjustable back module to base module at each of the first and second seat depths.

13. The exercise system of claim 8, further comprising a removable rearward seat board including (i) a seat plate, (ii) a rear seat pad attached to an upper surface of the seat plate, and (iii) at least one board coupling runner fixed to the seat plate opposite the rear seat pad, wherein the board coupling runner is configured to securely engage in a complementary fashion with the seat mating groove when the rearward seat board is engaged with the base module.

14. An exercise system, comprising:

a base module including a seat portion having a seat depth in a lengthwise direction from a front portion of the base module toward a rear portion of the base module;

an adjustable back module configured to fixedly engage with the base module at a first seat depth and a second seat depth different from the first seat depth in the lengthwise direction;

a foot paddle unit disposed proximate the front portion of the base module opposite the rear portion of the base module, the foot paddle unit including (i) a paddle crossbar disposed forward of the front portion and along a widthwise direction perpendicular to the lengthwise direction, (ii) a paddle pivot joint fixedly attached with respect to the base module proximate a base bottom portion of the base module forward of the rear portion, and (iii) a forward paddle extending bar operably coupling the paddle crossbar to the paddle pivot joint; and a detachable platform module configured for fixedly engaging with the respective second horizontal base support members of the two opposing base sides beneath the base module in the heightwise direction, wherein the seat portion is disposed opposite the base bottom portion, and includes two opposing base sides distributed substantially parallel one another across the foot paddle unit and structurally coupling the seat portion to the base bottom portion, wherein the two opposing base sides each includes (i) a first horizontal base support member disposed proximate the seat portion, (ii) a second horizontal base support member disposed proximate the base bottom portion, and (iii) a plurality of vertical base support members fixedly coupling the first horizontal base support member to the second horizontal base support member, wherein the seat portion includes (i) a back module engagement mechanism for fixedly engaging the adjustable back module to the base module at each of the first and second seat depths, and (ii) a forward seat pad fixedly attached to the base module above the back module engagement mechanism in the heightwise direction, wherein the detachable platform module extends forward from the rear portion of the base module to a front platform end located forward of the forward paddle extending bar, wherein the detachable platform module comprises an adjustable platform shelf configured for slidable extension between (i) a first shelf position nested entirely within the detachable platform module, and (ii) a second shelf position extending rearward from the rear portion of the base module.

15. The exercise system of claim 14, wherein the detachable platform module further comprises an adjustable platform shelf fastener for detachably fixing the adjustable platform shelf to the detachable platform module at each of the first and second shelf positions.

* * * * *